US011396038B2

(12) United States Patent
Yabunaka et al.

(10) Patent No.: US 11,396,038 B2
(45) Date of Patent: Jul. 26, 2022

(54) FASTENING TOOL

(71) Applicant: MAKITA CORPORATION, Anjo (JP)

(72) Inventors: Toshihito Yabunaka, Anjo (JP); Hiroki Ikuta, Anjo (JP); Takao Kuroyanagi, Anjo (JP); Koichi Yakabe, Anjo (JP)

(73) Assignee: MAKITA CORPORATION, Anjo (JP)

( * ) Notice: Subject to any disclaimer, the term of this patent is extended or adjusted under 35 U.S.C. 154(b) by 28 days.

(21) Appl. No.: 17/003,306

(22) Filed: Aug. 26, 2020

(65) Prior Publication Data

US 2021/0069773 A1 Mar. 11, 2021

(30) Foreign Application Priority Data

Sep. 6, 2019 (JP) ..... JP2019-163281
Sep. 6, 2019 (JP) ..... JP2019-163284
Sep. 6, 2019 (JP) ..... JP2019-163285

(51) Int. Cl.
*B21J 15/10* (2006.01)
*B21J 15/28* (2006.01)
*B21J 15/26* (2006.01)
*B21J 15/04* (2006.01)

(52) U.S. Cl.
CPC ..... *B21J 15/105* (2013.01); *B21J 15/26* (2013.01); *B21J 15/285* (2013.01); *B21J 15/045* (2013.01)

(58) Field of Classification Search
CPC ..... B21J 15/022; B21J 15/043–15/045; B21J 15/105; B21J 15/12; B21J 15/26; B21J 15/285
See application file for complete search history.

(56) References Cited

U.S. PATENT DOCUMENTS 3,410,128 A * 11/1968 Sauter ..... B21J 15/105 29/243.526
4,807,498 A * 2/1989 Kleiser ..... B21J 15/326 81/56
5,473,805 A * 12/1995 Wille ..... B21J 15/26 29/243.526
6,237,390 B1 * 5/2001 Honsel ..... B21J 15/043 29/243.526

(Continued)

FOREIGN PATENT DOCUMENTS

JP 2018-103257 A 7/2018
WO WO-2018123744 A1 * 7/2018 ..... B21J 15/105

*Primary Examiner* — Matthew P Travers
(74) *Attorney, Agent, or Firm* — Oliff PLC

(57) ABSTRACT

A fastening tool includes a housing, a handle, an anvil, a pin-gripping part, a motor, and a driving mechanism. The driving mechanism is configured to move the pin-gripping part along a first axis defining a front-rear direction, relative to the anvil. The driving mechanism includes a rotary member, a movable member, a driving gear and an idler gear. The rotary member has a driven gear formed on its outer periphery and is rotatable around the first axis. The movable member is connected to the pin-gripping part and configured to be linearly moved in the front-rear direction by rotation of the rotary member. The driving gear is configured to be rotated around a second axis extending in parallel to the first axis below the first axis. The idler gear is engaged with the driving gear and the driven gear.

18 Claims, 15 Drawing Sheets

(56) References Cited

U.S. PATENT DOCUMENTS

| | | | | |
|---|---|---|---|---|
| 10,232,429 | B1 * | 3/2019 | Lin | B21J 15/28 |
| 2008/0012453 | A1 * | 1/2008 | Aasgaard | B21J 15/26<br>310/75 R |
| 2011/0239449 | A1 * | 10/2011 | Masugata | B21J 15/26<br>29/715 |
| 2014/0041193 | A1 * | 2/2014 | Schlafhauser | B21J 15/285<br>29/432 |
| 2015/0033525 | A1 * | 2/2015 | Sugata | B21J 15/105<br>29/243.526 |
| 2015/0074964 | A1 * | 3/2015 | Masugata | B21J 15/26<br>29/243.526 |
| 2015/0328764 | A1 * | 11/2015 | Yoshikane | B25D 16/00<br>173/104 |
| 2015/0336159 | A1 * | 11/2015 | Gaertner | B21J 15/26<br>29/525.06 |
| 2018/0126446 | A1 * | 5/2018 | Mori | B21J 15/043 |
| 2019/0013763 | A1 * | 1/2019 | Woyciesjes | H02P 29/40 |
| 2019/0283110 | A1 * | 9/2019 | Kawai | B21J 15/26 |
| 2019/0283111 | A1 * | 9/2019 | Kawai | B21J 15/26 |
| 2019/0283112 | A1 * | 9/2019 | Ikuta | B21J 15/022 |
| 2019/0314888 | A1 * | 10/2019 | Ikuta | B21J 15/36 |
| 2019/0351477 | A1 * | 11/2019 | Yabuguchi | B21J 15/045 |
| 2020/0238489 | A1 * | 7/2020 | Mori | B21J 15/12 |

* cited by examiner

FASTENING TOOL

CROSS-REFERENCE TO RELATED APPLICATION

The present application claims priority to Japanese patent application No. 2019-163281 filed on Sep. 6, 2019, Japanese patent application No. 2019-163284 filed on Sep. 6, 2019, and Japanese patent application No. 2019-163285 filed on Sep. 6, 2019. The contents of the foregoing applications are fully incorporated herein by reference.

TECHNICAL FIELD

The present disclosure relates to a fastening tool configured to fasten workpieces via a fastener.

BACKGROUND

A fastening tool is known which is configured to fasten a plurality of workpieces via a fastener (for example, a multi-piece swage type fastener or a blind rivet) having a pin and a cylindrical part. For example, Japanese Unexamined Patent Application Publication No. 2018-103257 discloses a fastening tool which is configured to move a pin-gripping part gripping the pin of the fastener, using a ball-screw mechanism, relative to an anvil engaged with the cylindrical part of the fastener, to thereby strongly pull the pin in an axial direction and deform the fastener, thus fastening workpieces. The ball-screw mechanism includes a nut which is rotatably supported by a housing and a screw shaft which linearly moves along with rotation of the nut.

SUMMARY

The present disclosure herein provides a fastening tool which is configured to fasten workpieces via a fastener having a pin and a cylindrical part. The fastening tool includes a housing, a handle, an anvil, a pin-gripping part, a motor and a driving mechanism.

The housing extends along a first axis. The first axis defines a front-rear direction of the fastening tool. The handle protrudes from the housing in a direction crossing the first axis. The anvil is configured to abut on the cylindrical part of the fastener. Further, the anvil is connected to a front end portion of the housing so as to extend along the first axis. The pin-gripping part is configured to grip the pin. The pin-gripping part is held to be movable along the first axis relative to the anvil. The motor is housed in the housing. The driving mechanism is at least partially housed in the housing. Further, the driving mechanism is configured to be driven by power of the motor and move the pin-gripping part in the front-rear direction relative to the anvil.

The driving mechanism includes a rotary member, a movable member, a driving gear and an idler gear. The rotary member has a driven gear formed on an outer periphery of the rotary member. The rotary member is supported by the housing so as to be rotatable around the first axis. The movable member is connected to the pin-gripping part. The movable member is engaged with the rotary member. Further, the movable member is configured to be linearly moved in the front-rear direction by rotation of the rotary member. The driving gear is disposed on a second axis and configured to be rotated around the second axis by power of the motor. When a direction which is orthogonal to the first axis and which corresponds to an extending direction of the handle is defined as an up-down direction of the fastening tool, and in the up-down direction, a direction toward which the handle protrudes from the housing is defined as a downward direction, the second axis extends in parallel to the first axis below the first axis. The idler gear is engaged with the driving gear and the driven gear.

DETAILED DESCRIPTION OF THE EMBODIMENTS

First Embodiment

A fastening tool 101 according to a first embodiment is now described with reference to FIGS. 1 to 7. The fastening tool 101 is configured to fasten workpieces with a fastener. Further, plural kinds of fasteners can be selectively used with the fastening tool 101. First, a fastener 8 is described with reference to FIG. 1. The fastener 8 is an example of the fasteners which can be used with the fastening tool 101.

Figure 1:
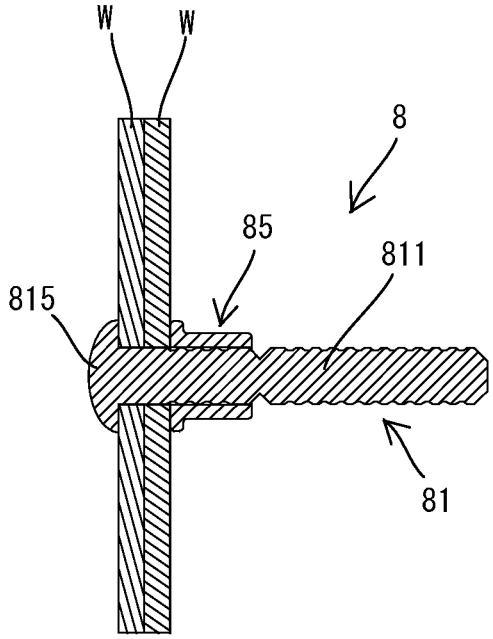
FIG. 1 is an explanatory drawing for illustrating an example of a fastener.

The fastener 8 shown in FIG. 1 is an example of a known fastener which is referred to as a multi-piece swage type fastener. The fastener 8 includes a pin 81 and a collar 85. The pin 81 includes a shaft part 811 and a head 815 which is integrally formed on one end portion of the shaft part 811. The collar 85 is a cylindrical member through which the shaft part 811 can be inserted. The pin 81 and the collar 85 are originally separate from each other. The collar 85 may be deformed by the fastening tool 101 (see FIG. 2) pulling the shaft part 811 of the pin 81 in an axial direction relative to the collar 85, and workpieces W can be fastened between the head 815 of the pin 81 and the collar 85 swaged onto the shaft part 811 of the pin 81.

The multi-piece swage type fastener includes two types. The first type is a fastener in which a portion (which may be referred to as a pintail or a mandrel) of a shaft part of a pin is supposed to be torn off or broken (hereinafter simply referred to as a tear-off type or breakage type fastener). The second type is a fastener in which a shaft part of a pin is supposed to be retained as it is, without being torn off (hereinafter simply referred to as a shaft-retaining type fastener). The fastener 8 is of a tear-off type in which the shaft part is to be torn off. Both types of fasteners are available in plural kinds, varying, for example, in the axial length, diameter and material of a pin and a collar and the position, number and shape of grooves formed in the shaft part. The fastening tool 101 can be used with selected one of the plural kinds of fasteners, by replacing a nose assembly 61 (see FIG. 2).

The general structure of the fastening tool 101 is now described.

Figure 2:
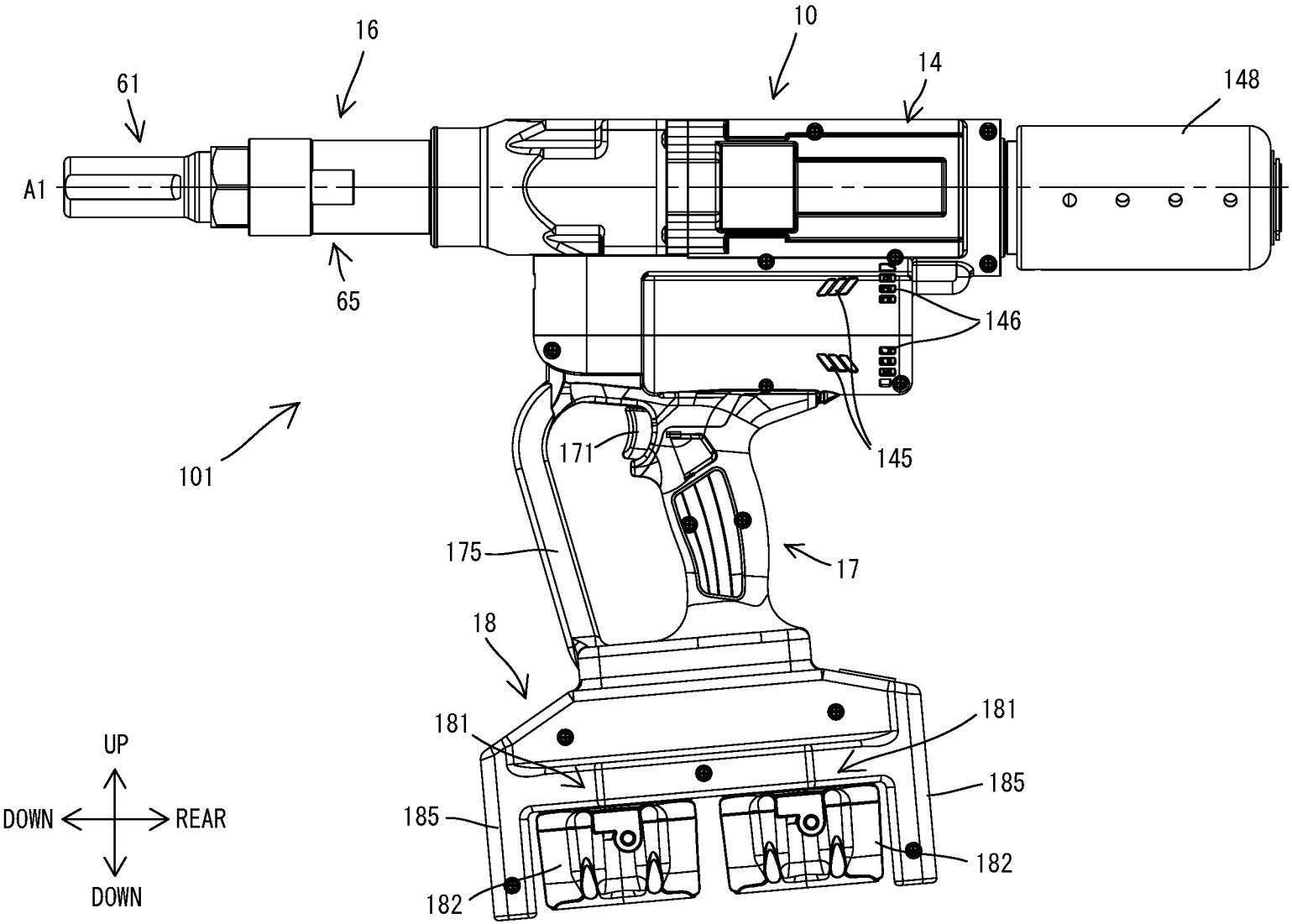
FIG. 2 is a left side view of a fastening tool.
Figure 3:
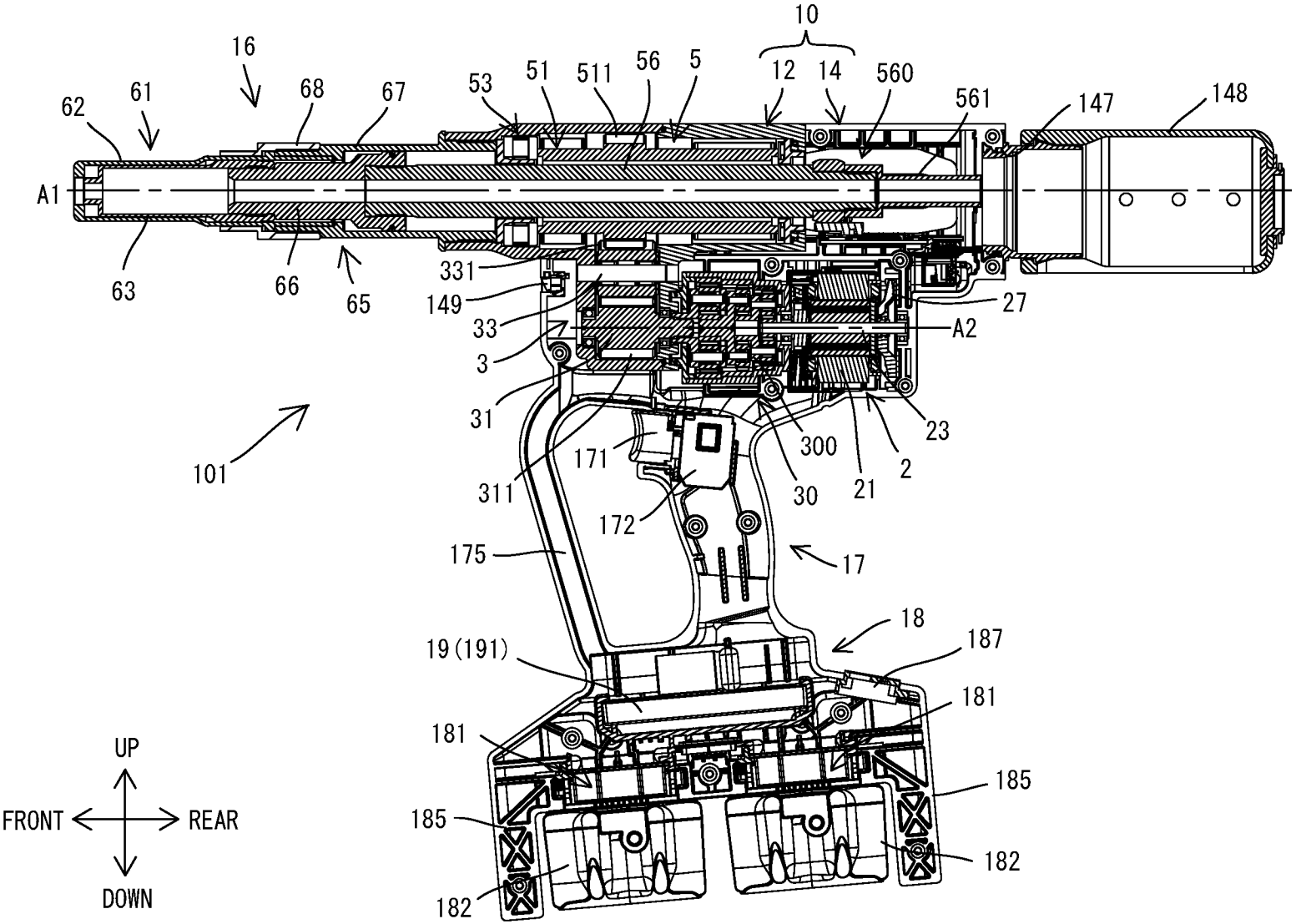
FIG. 3 is a sectional view of the fastening tool, where a screw shaft is placed in an initial position.

As shown in FIGS. 2 and 3, an outer shell of the fastening tool 101 is mainly formed by a body housing 10, a nose 16, a handle 17 and a battery housing 18. The body housing 10 has a rectangular box-like shape as a whole and extends along a driving axis A1. The body housing 10 houses a motor 2 and a driving mechanism 3. The nose 16 protrudes along the driving axis A1 from one end portion of the body housing 10 in a longitudinal direction (i.e. an extending direction of the driving axis A1). The handle 17 protrudes in a direction crossing (specifically, a direction substantially orthogonal to) the driving axis A1 from a central portion of the body housing 10 in the longitudinal direction. The handle 17 has a trigger 171 configured to be depressed by a user. The battery housing 18 has an inverted U-shape as a whole and is connected to a protruding end of the handle 17. A rechargeable battery 182 may be removably mounted to the battery housing 18. When a user engages the fastener 8 (see FIG. 1), for example, with a front end portion of the nose 16 and depresses the trigger 171, the motor 2 is driven and the pin 81 is pulled in the axial direction relative to the collar 85 and workpieces are fastened by the fastener 8.

In the following description, for convenience of explanation, as for the direction of the fastening tool 101, an extending direction of the driving axis A1 (or a longitudinal axis of the body housing 10) is defined as a front-rear direction of the fastening tool 101. In the front-rear direction, the side on which the nose 6 is arranged is defined as a front side and the opposite side is defined as a rear side. Further, a direction which is orthogonal to the driving axis A1 and which corresponds to the extending direction of a longitudinal axis of the handle 17 is defined as an up-down direction. In the up-down direction, a protruding-end side (a side on which the battery housing 18 is located) of the handle 17 is defined as a lower side, and a base-end side (a side on which the body housing 10 is located) of the handle 17 is defined as an upper side. A direction which is orthogonal both to the front-rear direction and the up-down direction is defined as a left-right direction.

The detailed structure of the fastening tool 101 is now described.

Figure 4:
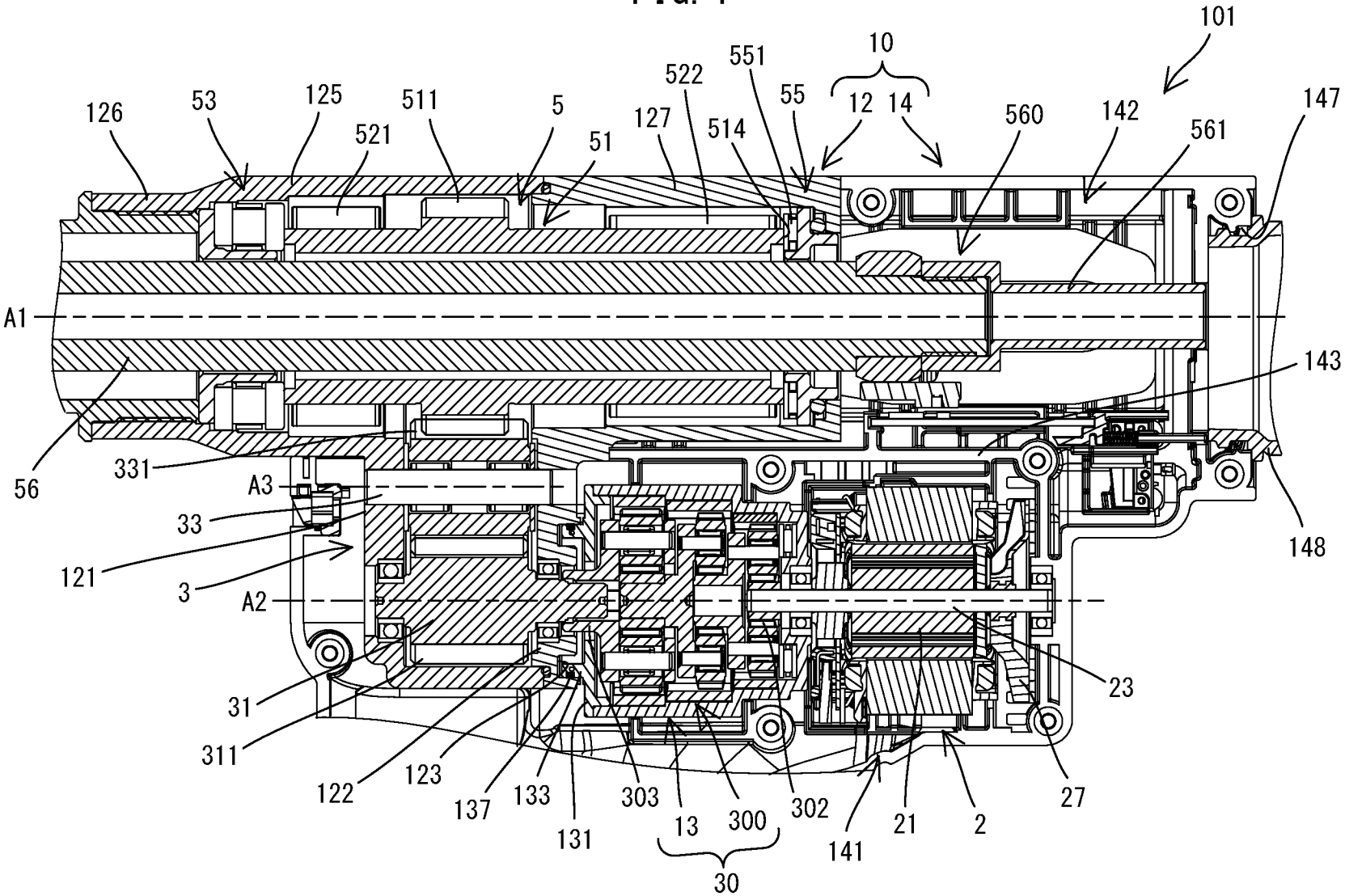
FIG. 4 is a partial, enlarged view of FIG. 3.

First, the internal structure of the body housing 10 is described. As shown in FIG. 4, the body housing 10 mainly houses the motor 2 and the driving mechanism 3 which is configured to be driven by the motor 2.

The motor 2 is housed in a lower rear end portion of the body housing 10. In this embodiment, a brushless direct current (DC) motor is employed as the motor 2. The motor 2 includes a motor body 21 and motor shaft 23. The motor body 21 includes a stator and a rotor. The motor shaft 23 is configured to rotate together with the rotor. The motor 2 is arranged such that a rotation axis A2 of the motor shaft 25 extends in parallel to the driving axis A1 (i.e. in the front-rear direction) below the driving axis A1. A fan 27 is fixed to a rear end portion of the motor shaft 23.

The driving mechanism 3 is configured to move a jaw assembly 63 (see FIG. 3) along the driving axis A1 in the front-rear direction relative to an anvil 62 (see FIG. 3) by power of the motor 2. In this embodiment, the driving mechanism 3 includes a planetary gear reducer 300, a nut-driving gear 311 provided on a first intermediate shaft 31, an idler gear 331 provided on a second intermediate shaft 33, and a ball-screw mechanism 5, of which structures are now described in this order.

The planetary gear reducer 300 is disposed coaxially with the motor 2 in front of the motor 2 within the body housing 10. The planetary gear reducer 300 is a gear reducer with planetary gear mechanisms. The planetary gear reducer 300 is configured to increase torque inputted from the motor shaft 23 and output the torque to the first intermediate shaft 31. In this embodiment, the planetary gear reducer 300 is configured as a three-stage planetary gear reducer including three sets of planetary gear mechanisms. The structure of the planetary gear mechanism itself is well known and is therefore not described in detail here. A sun gear 302 of the first-stage planetary gear mechanism (i.e. the most upstream planetary gear mechanism on a power transmission path) is connected to the motor shaft 23, which serves as an input shaft of the planetary gear reducer 300. An output shaft of the planetary gear reducer 300 is a carrier 303 of the third-stage planetary gear mechanism (i.e. the most downstream planetary gear mechanism on the power transmission path). The planetary gear reducer 300 is housed in a gear-reducer case 13 and held by the body housing 10.

The first intermediate shaft 31 is arranged coaxially with the motor shaft 23 and the planetary gear reducer 300 within the body housing 10, and extends forward from the planetary gear reducer 300 along the rotation axis A2. The first intermediate shaft 31 is connected to the carrier 303 of the third-stage planetary gear reducer mechanism of the planetary gear reducer 300. The first intermediate shaft 31 is supported rotatably around the rotation axis A2 by bearings and configured to rotate together with the carrier 303. The nut-driving gear 311 is integrally formed on an outer periphery of the first intermediate shaft 31.

The second intermediate shaft 33 extends in parallel to the first intermediate shaft 31 above the first intermediate shaft 31. The idler gear 331 is supported by the second intermediate shaft 33 via a bearing. The idler gear 331 is rotatable around a rotation axis A3 (an axis of the second intermediate shaft 33) relative to the second intermediate shaft 33. The idler gear 331 is engaged with the nut-driving gear 311 and a driven gear 511 of a nut 51, but does not affect the rotation speed ratio (gear ratio) between the nut-driving gear 311 and the driven gear 511.

The ball-screw mechanism 5 mainly includes the nut 51 and a screw shaft 56. In this embodiment, the ball-screw mechanism 5 is configured to convert rotation of the nut 51 into linear motion of the screw shaft 56 and to linearly move the jaw assembly 63.

The nut 51 is supported by the body housing 10 so as to be rotatable around the driving axis A1 and to be restricted from moving in the front-rear direction. The nut 51 has a driven gear 511 integrally formed on its outer periphery. The nut 51 is supported by bearings (radial bearings) 521 and 522 in front of and behind the driven gear 511. The nut-driving gear 311 and the driven gear 511 form a speed-reducing gear mechanism.

In this embodiment, the nut 51 has an elongate cylindrical shape. The length of the nut 51 in the front-rear direction is longer than the total length of the planetary gear reducer 300 and the first intermediate shaft 31. A front end of the nut 51 is located forward of front ends of the nut-driving gear 311 and the idler gear 331. A rear end of the nut 51 is located substantially on the same position in the front-rear direction as a rear end of the planetary gear reducer 300.

The driven gear 511 is arranged forward of the center of the nut 51 in the axial direction (the front-rear direction) of the nut 51. Thus, a portion of the nut 51 extending rearward of the driven gear 511 is relatively long. The planetary gear reducer 300 is disposed in a space directly below this portion. Thus, when the driving mechanism 3 is viewed from above or below, the portion of the nut 51 extending rearward of the driven gear 511 is at least partially overlaps with the planetary gear reducer 300. In this embodiment, with such arrangement, the fastening tool 101 is made relatively small in the front-rear direction.

Figure 5:
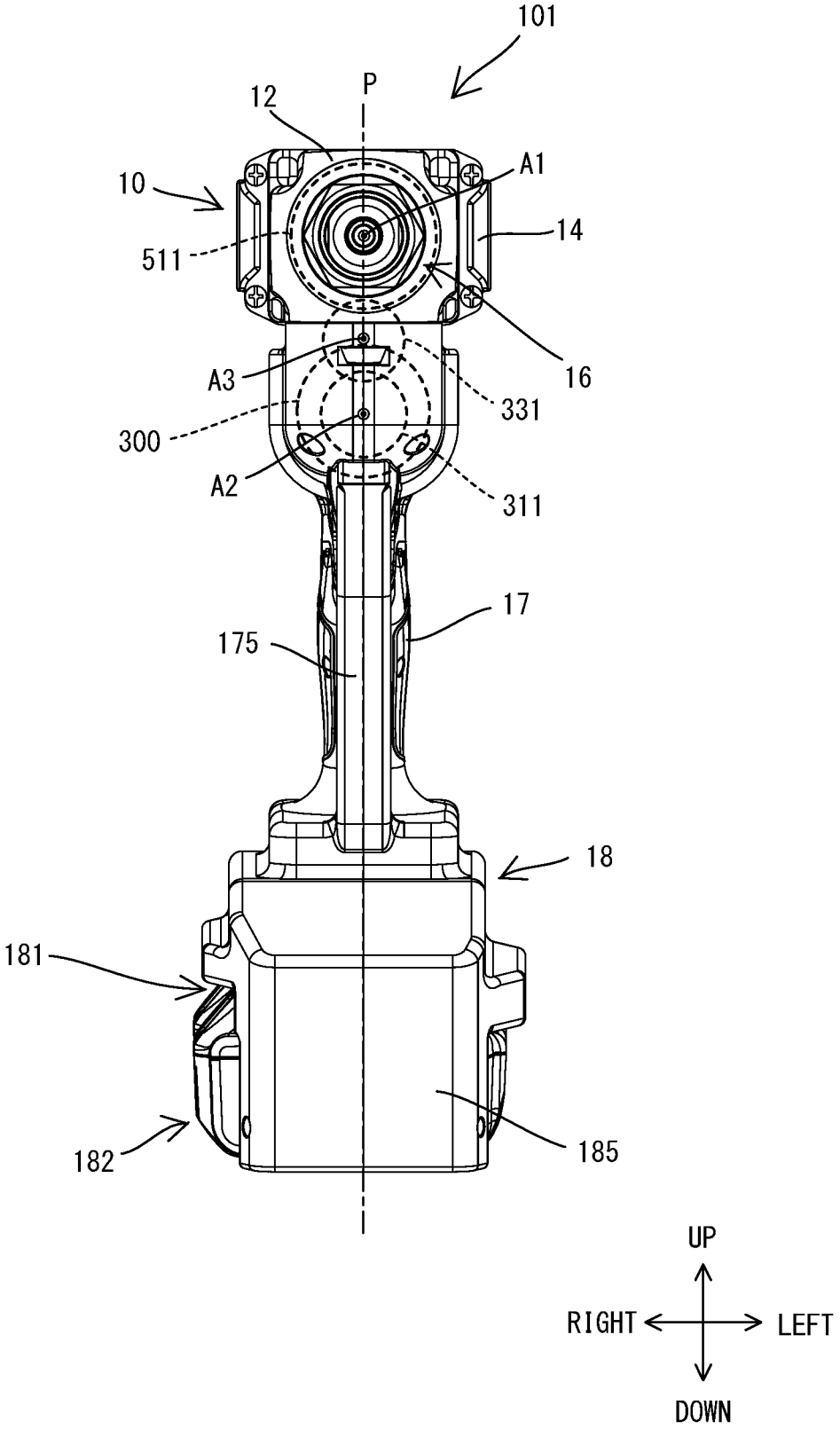
FIG. 5 is a front view of the fastening tool.

Further, as shown in FIG. 5, the driving axis A1 (i.e. the rotation axis of the driving gear 511), the rotation axis A2 (i.e. the rotation axis of the motor shaft 23, the output shaft (the third-stage carrier 303) of the planetary gear reducer 300 and the nut-driving gear 311), and the rotation axis A3 (i.e. the rotation axis of the idler gear 331) are all located on the same plane P. The plane P is an imaginary plane which is orthogonal to an axis extending in the left-right direction. Further, when viewed from the front (or rear), the planetary gear reducer 300 and the idler gear 331 are arranged to partially overlap with each other in the up-down direction. With such arrangement, the fastening tool 101 is made relatively small in the up-down direction.

In a fastening process, a strong axial force is applied to the nut 51 in the extending direction of the driving axis A1 (the front-rear direction), which will be described in detail later. Therefore, as shown in FIG. 4, a front-receiving part 53 and a rear-receiving part 55 are respectively provided in front of and behind the nut 51 in the front-rear direction. The front-receiving part 53 and the rear-receiving part 55 are configured to receive forward and rearward axial forces (thrust loads) which are applied to the nut 51, respectively. The front and rear-receiving parts 53 and 55 will be described in detail later.

The screw shaft 56 is engaged with the nut 51 so as to be movable along the driving axis A1 in the front-rear direction and to be prevented from rotating around the driving axis A1. More specifically, the screw shaft 56 has an elongate shape, and is inserted through the nut 51 to extend along the driving axis A1. Although not shown in detail, a track is defined by a spiral groove formed in an inner peripheral surface of the nut 51 and a spiral groove formed in an outer peripheral surface of the screw shaft 56. A number of balls are rollably disposed within the track. The screw shaft 56 is engaged with the nut 51 via these balls.

Although not shown in detail, a pair of arms are provided on a rear end portion of the screw shaft 56. The arms extend from the screw shaft 56 to the left and right. Each of the arms rotatably supports a roller. The rollers are respectively engaged with guide grooves of roller guides fixed to the body housing 10. Each of the rollers is rollable along the guide groove in the front-rear direction while being prevented from moving in the up-down direction. With such structure, when the nut 51 is rotated around the driving axis A1, the screw shaft 56 linearly moves in the front-rear direction relative to the nut 51 and the body housing 10, while being prevented from rotating around the driving axis A1.

Figure 6:
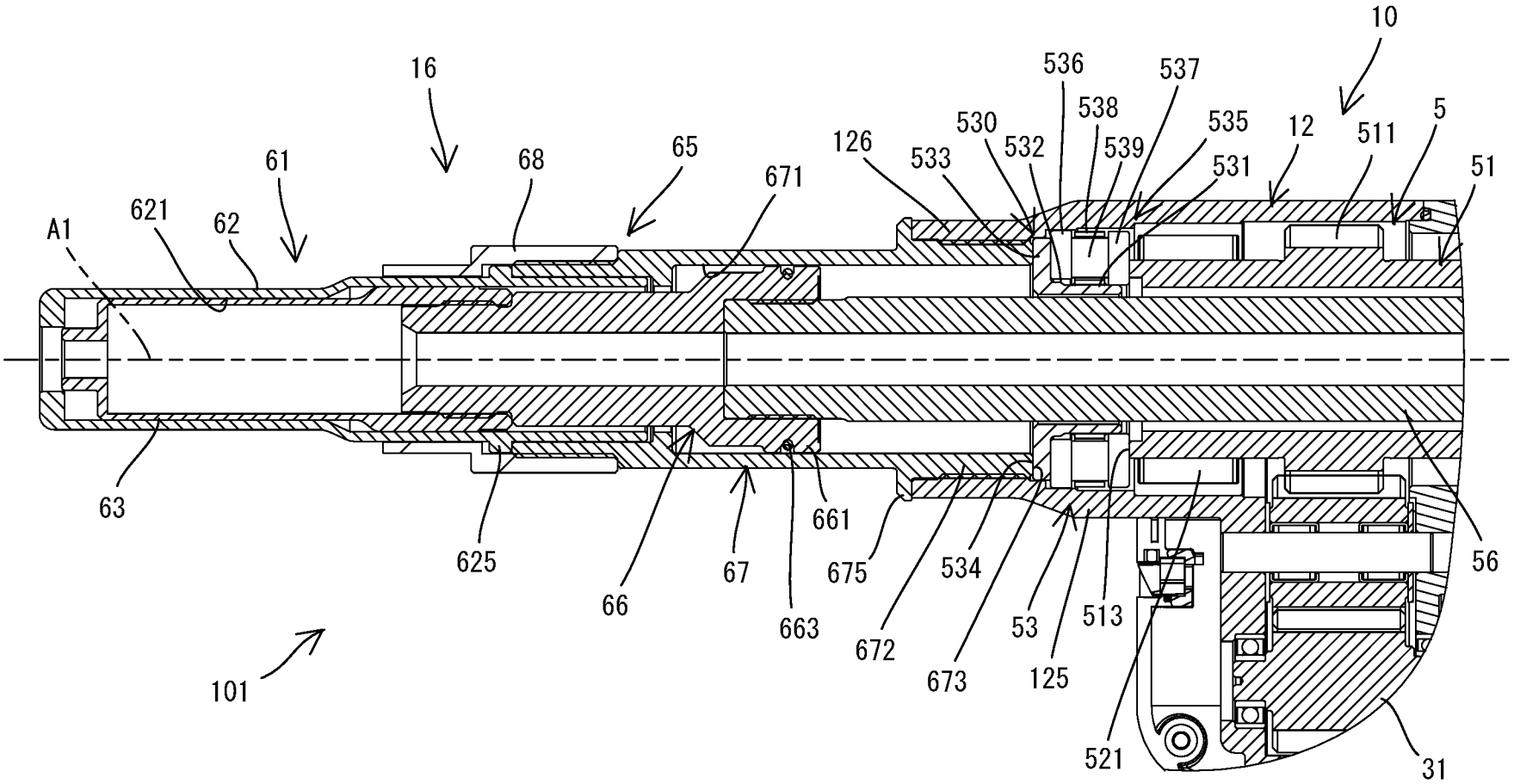
FIG. 6 is a partial, enlarged view of FIG. 3.

As shown in FIG. 6, the jaw assembly 63 is connected to a front end portion of the screw shaft 56 via a jaw-connecting member 66, which will be described in detail later. For this purpose, a male thread is formed on the front end portion of the screw shaft 56.

As shown in FIG. 4, an extension shaft 561 is coaxially connected and fixed to the rear end portion of the screw shaft 56 and integrated with the screw shaft 56. The screw shaft 56 and the extension shaft 561 which are integrated with each other are hereinafter also collectively referred to as a driving shaft 560. The driving shaft 560 has a through hole extending therethrough along the driving axis A1. An opening 147 having a circular section is formed on the driving axis A1 in the rear end portion of the body housing 10. The opening 147 is configured such that a container 148 can be removably attached thereto. The container 148 is provided to store a pintail separated in the fastening process. The pintail separated from the fastener may reach the container 148 through the through hole of the driving shaft 560 and may be stored in the container 148.

In the driving mechanism 3 having the above-described structure, torque of the motor 3 is increased by the planetary gear reducer 300 disposed on the rotation axis A2, and transmitted to the nut-driving gear 311 which is rotated around the rotation A2, and then transmitted to the driven gear 511 of the nut 51 disposed on the driving axis 51 via the idler gear 331. By thus providing the idler gear 331 between the nut-driving gear 311 and the driven gear 511, the driven gear 511 can be reduced in diameter, compared with a structure in which the nut-driving gear 311 is directly engaged with the driven gear 511. Thus, increase of the distance from the driving axis A1 to an upper surface of the body housing 10 (so-called center height) can be suppressed. Further, by such arrangement of the idler gear 331, the distance between the driving axis A1 and the rotation axis A2 in the up-down direction can be increased, so that the relatively large planetary gear reducer 300 can be arranged on the rotation axis A2, thereby realizing higher output.

The structure of the body housing 10 is now described in detail. As shown in FIG. 4, the body housing 10 includes a first housing 12 and a second housing 14 which are connected together.

In this embodiment, the first housing 12 houses the first intermediate shaft 31, the nut-driving gear 311, the second intermediate shaft 33, the idler gear 331 and the nut 51 of the driving mechanism 3.

The first housing 12 is a hollow metal body. In this embodiment, the first housing 12 is formed of an aluminum-based alloy for weight reduction. An upper half of the first housing 12 which houses the nut 51 has a longer length in the front-rear direction than a lower half of the first housing 12 which houses the nut-driving gear 311 and the idler gear 331, due to the above-described relation between the lengths of the nut 51 and the first intermediate shaft 31 in the front-rear direction. A front part 125 and a rear part 127 of the upper half each have a cylindrical shape, and respectively protrude forward and rearward of the lower half.

The first housing 12 supports the first intermediate shaft 31, the second intermediate shaft 33 and the nut 51. More specifically, the first intermediate shaft 31 is supported via bearings which are respectively held by a front wall 121 and a rear wall 122 of the lower half of the first housing 12. A rear end portion of the first intermediate shaft 31 protrudes rearward from a through hole of the rear wall 122. The second intermediate shaft 33 is fitted and supported in support holes which are respectively formed in the front wall 121 and the rear wall 122. The nut 51 is supported via the bearings 521 and 522 which are respectively held within the cylindrical front and rear parts 125 and 127 of the first housing 12. Front and rear end portions of the driving shaft 560 respectively protrude forward and rearward from the first housing 12.

Further, in this embodiment, the planetary gear reducer 300 forms, together with the gear-reducer case 13 for housing the planetary gear reducer 300, a speed-reducer assembly 30 which is attachable to and removable from the first housing 12. The gear-reducer case 13 is a circular cylindrical hollow body as a whole, and includes a circular front wall 131, a circular rear wall and a circular cylindrical peripheral wall. The gear-reducer case 13 is formed of resin. The third-stage carrier 303 of the planetary gear reducer 300 protrudes from a central portion of the front wall 131. The rear end portion of the first intermediate shaft 31 is fitted in the carrier 303.

In order to make the speed-reducer assembly 30 attachable/removable, the rear wall 122 of the first housing 12 has an annular recess 123 recessed forward from its rear surface. Correspondingly, the front wall 131 of the gear-reducer case 13 has an annular projection 133 protruding forward. An annular sealing member (O-ring) 137 is fitted on an outer periphery of the projection 133. The sealing member 137 secures connection of the gear-reducer case 13 to the first housing 12, and also serves to prevent leakage of lubricant out of the first housing 12 and the gear-reducer case 13. The sealing member 137 may be mounted on the first housing 12 (on an inner periphery of the recess 123), instead of being mounted on the gear-reducer case 13.

By thus configuring the planetary gear reducer 300 and the gear-reducer case 13 as the single speed-reducer assembly 30 which can be removably attached to the first housing 12, assembling can be made easier.

The second housing 14 is formed of resin and houses a portion of the first housing 12 (specifically, the lower half of the first housing 12 which houses the nut-driving gear 311 and the idler gear 331), the speed-reducer assembly 30, the motor 2 and the rear end portion (a portion protruding from the first housing 12) of the driving shaft 560.

As shown in FIGS. 2 and 5, in this embodiment, the second housing 14 is formed by left and right halves being connected together by screws. Further, the left and right halves of the second housing 14 are respectively integrally formed with left and right halves of the handle 17, a hand guard 175 and the battery housing 18. The first housing 12 is partially sandwiched between the left and right halves of the second housing 14 and thus fixedly held by the second housing 14.

As shown in FIG. 4, the first housing 12 and the speed-reducer assembly 30 connected to the first housing 12 are disposed in a front region of the internal space of the second housing 14. The motor 2 and the rear end portion of the driving shaft 560 are disposed in a rear region of the internal space of the second housing 14. More specifically, the motor 2 is disposed in a lower half of the rear region, and the rear end portion of the driving shaft 560 is disposed in an upper half of the rear region. The lower half and the upper half of the rear region are hereinafter referred to as a motor region 141 and a shaft region 142, respectively.

As shown in FIG. 2, a plurality of inlets 145 and a plurality of outlets 146 are formed in a portion of the second housing 14 which covers the motor region 141. More specifically, the inlets 145 are formed radially outward of the motor body 21 and the outlets 146 are formed radially outward of the fan 27. When the motor 2 is driven and the fan 27 rotates together with the motor shaft 23, an air flow is generated by air flowing into the second housing 14 from the inlets 146, passing through the motor body 21 and the fan 27 and flowing out from the outlets 146. This air flow cools the motor 2.

As shown in FIG. 4, the second housing 14 has a partition wall 143 which partitions the motor region 141 and the shaft region 142. The partition wall 143 is connected to left and right walls of the second housing 14. The partition wall 143 extends forward from a substantially rear end of the second housing 14 up to a position where the partition wall 143 substantially comes in contact with the rear wall 122 of the first housing 12 above a front end portion of the planetary gear reducer 300. The partition wall 143 serves to prevent entry of dust into the shaft region 142 even when dust enters the motor region 141 from the inlets 145 together with cooling air for the motor 2.

The nose 16 is now described. As shown in FIG. 6, the nose 16 includes a nose assembly 61 and a nose adapter 65 configured to hold the nose assembly 61. The "assembly" used in this embodiment refers to not only a single assembly formed by assembling a plurality of parts, but a plurality of separate parts defined as a set to be used for specific application. The above-described speed-reducer assembly 30 corresponds to the former, and the nose assembly 61 corresponds to the latter. The nose assembly 61 and the nose adapter 65 are now described in this order.

The nose assembly 61 mainly includes the anvil 62 and the jaw assembly 63. The anvil 62 is configured to abut on (engage with) the collar 85 of the fastener 8 (see FIG. 1) and is held by the body housing 10. The jaw assembly 63 is configured to grip the pin 81 of the fastener 8 and held to be movable along the driving axis A1 in the front-rear direction relative to the anvil 62. The structure of the nose assembly 61 is known and therefore described in brief here.

The anvil 62 has a cylindrical shape as a whole and has a bore 621 extending along the driving axis A1. In this embodiment, the anvil 62 is formed of iron (or iron-based alloy) to secure sufficient strength. A front end portion of the bore 621 has a smaller diameter than the other portion of the bore 621 and is configured to abut on (engage with) the collar 85. Further, a locking flange 625 is formed slightly rearward of a central portion on an outer periphery of the anvil 62 and protrudes radially outward.

The jaw assembly 63 is held coaxially with the anvil 62 within the bore 621. The jaw assembly 63 can slide within the bore 621. Although not shown in detail, the jaw assembly 63 has a plurality of claws (or jaws) which are configured to grip the shaft part 811 (see FIG. 1) of the pin 81. The jaw assembly 63 is configured such that the gripping force of the claws increases as the jaw assembly 63 moves rearward from an initial position relative to the anvil 62. A rear end portion of the jaw assembly 63 has a cylindrical shape and has a threaded inner peripheral surface (female thread).

In this embodiment, the nose assembly 61 is configured to be removably attached to the front part 125 of the body housing 10 (specifically, the first housing 12) via the nose adapter 65. As described above, the fastening tool 101 of this embodiment can be selectively used with plural kinds of fasteners. A user may attach to the body housing 10 an appropriate kind of nose assembly 61, depending on a fastener to be actually used. In this embodiment, the nose assembly 61 for the tear-off type fastener 8 is described as an example. A nose assembly 61 for a shaft-retaining type fastener, although not described in detail, basically has the same structure as the nose assembly 61 for the fastener 8. Specifically, the nose assembly 61 for a shaft-retaining type fastener also has an anvil configured to abut on a collar of the fastener, and a pin-gripping part which has a plurality of claws configured to grip a pin and is held to be movable along the driving axis A1 relative to the anvil.

The nose adapter 65 is configured to connect the anvil 62 to the body housing 10 and to connect the jaw assembly 63 to the screw shaft 56. More specifically, the nose adapter 65 includes a jaw-connecting member 66, an anvil-connecting sleeve 67 and a fixing ring 68.

The jaw-connecting member 66 is a circular cylindrical member configured to connect the screw shaft 56 and the jaw assembly 63. The jaw-connecting member 66 has a front end portion, a central portion and a rear end portion which have respective outer diameters increasing in this order. The front end part portion the jaw-connecting member 66 is configured as a male thread which may be threadedly engaged with the female thread of the rear end portion of the jaw assembly 63. The outer diameter of the rear end portion of the jaw-connecting member 66 is substantially equal to the inner diameter of a rear portion of the anvil-connecting sleeve 67. The rear end portion of the jaw-connecting member 66 which has a large diameter is hereinafter referred to as a large-diameter part 661. The large-diameter part 661 is configured as a female thread which is threadedly engaged with the male thread formed on the front end portion of the screw shaft 56. In this manner, the jaw-connecting member 66 connects the screw shaft 56 and the jaw assembly 63 by threaded engagement with the front end portion of the screw shaft 56 and also with the rear end portion of the jaw assembly 63. Further, the jaw-connecting member 66 has a through hole, which extends through the jaw-connecting member 66 along the driving axis A1 and communicates with the through hole of the driving shaft 560.

The anvil-connecting sleeve 67 and the fixing ring 68 are members to connect the anvil 62 to the body housing 10 (specifically, the first housing 12).

The anvil-connecting sleeve 67 is configured as a stepped circular cylindrical body having a bore 671 extending along the driving axis A1. A rear portion of the anvil-connecting sleeve 67 has a larger diameter than a front portion of the anvil-connecting sleeve 67. In this embodiment, the anvil-connecting sleeve 67 is formed of iron (or iron-based alloy) to secure sufficient strength. The diameter of a front portion of the bore 671 is substantially equal to the outer diameter of the anvil 62. The anvil 62 is fitted in the front portion of the bore 671. The bore 671 has a rear portion having a larger diameter than the front portion. The large-diameter part 661 of the jaw-connecting member 66 is disposed within the rear portion of the bore 671 to be slidable along the driving axis A1. An annular sealing member (O-ring) 663 is fitted on an outer periphery of the large-diameter part 661. The sealing member 663 seals a gap between an outer peripheral surface of the large-diameter part 661 and an inner peripheral surface of the anvil-connecting sleeve 67. When dust enters the bore 671 through the bore 621 from the opening of the front end portion of the anvil 62, the sealing member 663 can prevent entry of the dust into the body housing 12.

A rear end portion of the anvil-connecting sleeve 67 is threadedly engaged and connected with the body housing 10 (specifically, the first housing 12). More specifically, a front end portion (a portion adjacent to an opening of a front end of the first housing 12) of the front part 125 of the first housing 12 is configured as a female-thread part 126 having a threaded inner peripheral surface. Correspondingly, the rear end portion of the anvil-connecting sleeve 67 is configured as a male-thread part 672 having a threaded outer peripheral surface to be threadedly engaged with the female-thread part 126. The female-thread part 126 and the male-thread part 672 are configured such that their screwing direction is opposite to the direction in which the nut 51 is rotated when the screw shaft 56 is moved rearward.

A flange 675 is formed on an outer periphery of the anvil-connecting sleeve 67 and protrudes radially outward. The anvil-connecting sleeve 67 is positioned in the front-rear direction such that the flange 675 abuts on a front end surface of the front part 125.

The fixing ring 68 is configured as a stepped circular cylindrical body. A rear portion of the fixing ring 68 has a larger diameter than a front portion of the fixing ring 68. The rear portion of the fixing ring 68 is configured as a female-thread part to be threadedly engaged with a male-thread part formed in a front end portion of the anvil-connecting sleeve 67.

The fixing ring 68 is connected to the anvil-connecting sleeve 67 in a state in which the anvil 62 is fitted in the bore 671 of the anvil-connecting sleeve 67. Thus, the anvil 62 is connected to the body housing 10 by the anvil-connecting sleeve 67 and the fixing ring 68. The locking flange 625 of the anvil 62 is disposed between a front end of the anvil-connecting sleeve 67 and a stepped part (a boundary between the front portion and the rear portion) on the inside of the fixing ring 68.

The front-receiving part 53 and the rear-receiving part 55 which are respectively provided in front of and behind the nut 51 are now described in detail.

As shown in FIG. 6, the front-receiving part 53 is disposed between a rear end surface 673 of the anvil-connecting sleeve 67 and a frond end surface 513 of the nut 51 in the extending direction of the driving axis A1 (i.e. the front-rear direction). The front-receiving part 53 is configured to receive a forward axial force from the nut 51 which is generated by rearward movement of the screw shaft 56 and transmit the axial force to the anvil-connecting sleeve 67 in a fastening process. The front-receiving part 53 includes a flange sleeve 530 and a thrust bearing 535.

The flange sleeve 530 is a cylindrical body having a substantially uniform inner diameter as a whole. The inner diameter of the flange sleeve 530 is slightly larger than the outer diameter of the screw shaft 56. The flange sleeve 530 includes a cylindrical part 531 and a flange 533. The cylindrical part 531 has a circular cylindrical shape. The flange 533 protrudes radially outward from one end of the cylindrical part 531 in the axial direction. A portion of the cylindrical part 531 which is adjacent to the flange 533 has an outer diameter slightly larger than the other portion. Thus, a stepped part 532 is formed adjacent to the flange 533 on an outer periphery of the cylindrical part 531. The outer diameter of the flange 533 is substantially equal to the inner diameter of the front part 125 (specifically, a portion of the front part 125 located rearward of the female-thread part 126) of the first housing 12.

The flange sleeve 530 is positioned such that the flange 533 is located on the front and the flange 533 is fitted in the front part 125. In this manner, the flange sleeve 530 is held in a state in which an inner peripheral surface of the flange sleeve 530 is spaced apart radially outward from the outer peripheral surface of the screw shaft 56. The flange sleeve 530 is held in contact with the first housing 12 only on the outer peripheral surface (i.e. a radially outer end surface) of the flange 533, and not in contact with the first housing 12 in the axial direction (i.e. the front-rear direction). A front end surface 534 of the flange 533 of the flange sleeve 530 is held in contact with the rear end surface 673 of the anvil-connecting sleeve 67.

The thrust bearing 535 is disposed radially outside of the cylindrical part 531 behind the flange 533 of the flange sleeve 530. The thrust bearing 535 includes a front raceway ring (hereinafter simply referred to as a front ring) 536, a rear raceway ring (hereinafter simply referred to as a rear ring) 537 and a plurality of rolling elements 539 arranged between the front ring 536 and the rear ring 537.

The front ring 536 is a fixed-side raceway ring which does not rotate together with the nut 51. The outer diameter of the front ring 536 is substantially equal to the inner diameter of the front part 125, and the inner diameter of the front ring 536 is slightly larger than the outer diameter of the stepped part 532 of the cylindrical part 531. The front ring 536 is positioned by being fitted in the front part 125, in a state in which the front ring 536 is in contact with a rear end surface of the flange 533 of the flange sleeve 530. In this manner, the front ring 536 is held in a state in which an inner peripheral surface of the front ring 536 is spaced apart radially outward from an outer peripheral surface of the cylindrical part 531 (the stepped part 532). Like the flange sleeve 530, the front ring 536 is also held in contact with the first housing 12 only on its outer peripheral surface (radially outer end surface) and not in contact with the first housing 12 in the axial direction (the front-rear direction).

The rear ring 537 is a rotation-side raceway ring which rotates together with the nut 51. The outer diameter of the rear ring 537 is smaller than the inner diameter of the front part 125, and the inner diameter of the rear ring 537 is substantially equal to the outer diameter of the cylindrical part 531 of the flange sleeve 530. The rear ring 537 is rotatably fitted on the outer periphery of the cylindrical part 531 while the rolling elements 539 are held between the rear ring 537 and the front ring 536. In this manner, the rear ring 537 is held in a state in which an outer peripheral surface of the rear ring 537 is spaced apart radially inward from an inner peripheral surface of the front part 125. The rear ring 537 is not held in contact with the first housing 12 not only on its outer peripheral surface (radially outer end surface) but also in the axial direction (the front-rear direction). The frond end surface 513 of the nut 51 is held in contact with the rear ring 537.

The rolling elements 539 are rollably held by a cage (retainer) 538 and arranged between the front ring 536 and the rear ring 537 in the front-rear direction. In this embodiment, a roller (specifically, a cylindrical roller) is employed as the rolling element. The cage 538 is fitted on the outer periphery of the cylindrical part 531 in a slipping state. An outer peripheral surface of the cage 538 is spaced apart radially inward from the inner peripheral surface of the front part 125.

As described above, in the front-receiving part 53 of this embodiment, the flange sleeve 530 is employed which has the flange 533 arranged between the anvil-connecting sleeve 67 and the thrust bearing 535 in the front-rear direction, and the cylindrical part 531 arranged between the screw shaft 56 and the thrust bearing 535 in the radial direction. By using such flange sleeve 530, a position of the thrust bearing 535 relative to the screw shaft 56, the nut 51, the anvil-connecting sleeve 67 and the first housing 12 can be properly defined and the thrust bearing 535 can be easily mounted.

In this embodiment, in order to prevent a mistake in mounting the thrust bearing 535, the stepped part 532 is formed on the cylindrical part 531 of the flange sleeve 530, and the front ring 536 and the rear ring 537 have different inner diameters. Specifically, an assembling worker needs to fit the front ring 536, the rolling elements 539 held by the cage 538, and the rear ring 537 onto the cylindrical part 531 in this order after fitting the flange sleeve 530 into the front part 125 of the first housing 12. If the worker mistakenly first fits the rear ring 537 onto the flange sleeve 530, the rear ring 537 is blocked by the stepped part 532 and cannot be moved further forward up to a proper position, which is intended for the front ring 536. Therefore, the worker can easily notice the mistake. However, the cylindrical part 531 of the flange sleeve 530 may be formed to have a uniform outer diameter, and the front ring 536 and the rear ring 537 may have the same inner diameter.

As shown in FIG. 4, the rear-receiving part 55 is disposed between a rear end surface 514 of the nut 51 and the body housing 10 (specifically, a rear wall of the first housing 12) in the extending direction of the driving axis A1 (i.e. the front-rear direction). The rear-receiving part 55 is configured to receive a rearward axial force from the nut 51 which is generated by forward movement of the screw shaft 56. The rear-receiving part 55 includes a thrust bearing 551. In this embodiment, a thrust needle bearing, which has needle rollers serving as rolling elements, is employed as the thrust bearing 551. This is because, in the fastening process, the rearward axial force to be applied to the nut 51 when the screw shaft 56 returns forward is smaller than the forward axial force to be applied to the nut 51 when the screw shaft 56 strongly pulls the pin while moving rearward.

The handle 17 is now described. As shown in FIG. 3, the handle 17 has an elongate cylindrical shape. The handle 17 extends contiguously downward from a lower end of a central portion of the body housing 10 in the front-rear direction. More specifically, the handle 17 extends downward from a portion of the body housing 10 (specifically, the second housing 14) directly below the planetary gear reducer 300. With this arrangement, a user can hold the handle 17 at a position close to the center of gravity of the driving mechanism 3.

The handle 17 is a portion to be held by a user. The trigger 171 is provided in an upper end portion of the handle 17 and configured to be depressed by the user. A switch 172 is housed within the handle 17. The switch 172 is normally kept off, and turned on in response to a depressing operation of the trigger 151. The switch 172 is electrically connected to a control circuit 191 of a controller 19 via wiring (not shown). When turned on, the switch 172 outputs an ON signal to the control circuit 191.

A hand guard 175 having an elongate cylindrical shape is provided in front of the handle 17. The hand guard 175 is spaced apart from the handle 17 and extends generally in the up-down direction. The hand guard 175 connects a lower front end portion of the body housing 10 (the second housing 14) and an upper end portion of the battery housing 18. The hand guard 175 is provided to secure the rigidity of the handle halves integrally formed with the second housing 14. In addition to this, the hand guard 175 serves to protect a hand of the user holding the handle 17. Further, in this embodiment, an LED lamp 149 is held in an opening formed in a front wall of the second housing 14. Although not shown in detail, an internal space of the hand guard 175 is utilized as a path for wiring for connecting the LED lamp 149 with the controller 19.

The battery housing 18 is now described. As shown in FIG. 3, the battery housing 18 has a hollow inverted U-shape which is relatively long in the front-rear direction. The lengths of the battery housing 18 in the front-rear direction and the left-right direction are larger than those of a lower end portion of the handle 17. The controller 19 is housed in the battery housing 18. The controller 19 includes the control circuit 191 which is configured to control operations of the fastening tool 101. In this embodiment, the control circuit 191 is formed by a microcomputer including a CPU, a ROM and a RAM. Although not shown in detail, the control circuit 191 is mounted on a circuit board housed in a case, together with a driving circuit for the motor 2.

Two battery-mounting parts 181 are provided in a lower end portion of the battery housing 18. Each of the battery-mounting parts 181 is configured to removably receive the battery 182. Thus, in this embodiment, two batteries 182 can be mounted to the fastening tool 101. The battery 182 is a rechargeable power source for supplying power to various parts of the fastening tool 101 and the motor 2, and may also be referred to as a battery pack. The structures of the battery-mounting part 181 and the battery 182 are well known and not therefore described here. In this embodiment, the two battery-mounting parts 181 are arranged side by side in the front-rear direction.

The battery housing 18 includes battery guards 185. Each of the battery guard 185 is configured to protect an exposed portion of the battery 182 from an external force when the battery 182 is mounted to the battery-mounting part 181. In this embodiment, two battery guards 185 are located to the front of and to the rear of the battery-mounting parts 181, respectively. The two battery guards 185 are portions of the battery housing 18 which protrude downward relative to the battery-mounting parts 181, with the two battery-mounting parts 181 located therebetween.

Further, an operation part 187 is provided on an upper surface of a rear end portion of the battery housing 18. The operation part 187 is an input device which can be externally operated by a user. In this embodiment, although not shown in detail, the operation part 187 has a plurality of push-button switches configured to be pressed by a user. The operation part 187 further has a display part for displaying information. A user can input various information by pressing the switches of the operation part 187.

In this embodiment, as described above, the fastening tool 1 may be used with a tear-off type fastener (such as the fastener 8 shown in FIG. 1) and a shaft-retaining type fastener. Therefore, the control circuit 191 is configured to control driving of the motor 2 according to an operation mode which is appropriate to the type of the fastener to be used. For this purpose, the user can input information for specifying the operation mode via the operation part 187. The operation part 187 (the switches) is electrically connected to the control circuit 191 of the controller 19 via wiring (not shown). The operation part 187 is configured to output signals indicating the on/off state of each of the switches to the control circuit 191. Further, the operation part 187 is provided in the vicinity of the controller 19, which facilitates wiring in the assembling process of the fastening tool 101.

An operation of fastening workpieces by using the fastening tool 101 is now described.

First, a user temporarily fixes a fastener to be used (the fastener 8 shown in FIG. 1 or other fastener) to the workpieces. As exemplified in FIG. 1, to "temporarily fix" means to insert the shaft part 811 of the pin 81 through holes formed in the workpieces W such that the head 815 of the fastener 8 is held in abutment with one side of the workpieces W, and loosely engage the collar 85 with the shaft part 811 from the other side of the workpieces W.

The user attaches to the fastening tool 101 the nose assembly 61 which is appropriate to the fastener to be used. Further, the user specifies the operation mode which is appropriate to the type of the fastener to be used, via the operation part 187. The operation part 187 is disposed behind the handle 17 such that the operation part 187 can be operated from above. Therefore, the user can easily visually check and operate the operation part 187 while holding the handle 17.

As shown in FIG. 3, in the initial state in which the trigger 171 is not depressed, the screw shaft 56 (i.e. the driving shaft 560) and the jaw assembly 63 are located in their initial positions (foremost positions). The user engages a front end portion of the anvil 62 with the collar of the temporarily fixed fastener (see FIG. 1), such that a front end portion (claws) of the jaw assembly 63 loosely grips the shaft part of the pin. When the trigger 171 is depressed by the user and the switch 172 is turned on, the control circuit 191 of the controller 19 starts normal rotation driving of the motor 2. Torque is increased via the planetary gear reducer 300, the nut-driving gear 311 and the driven gear 511 and then transmitted to the nut 51.

Figure 7:
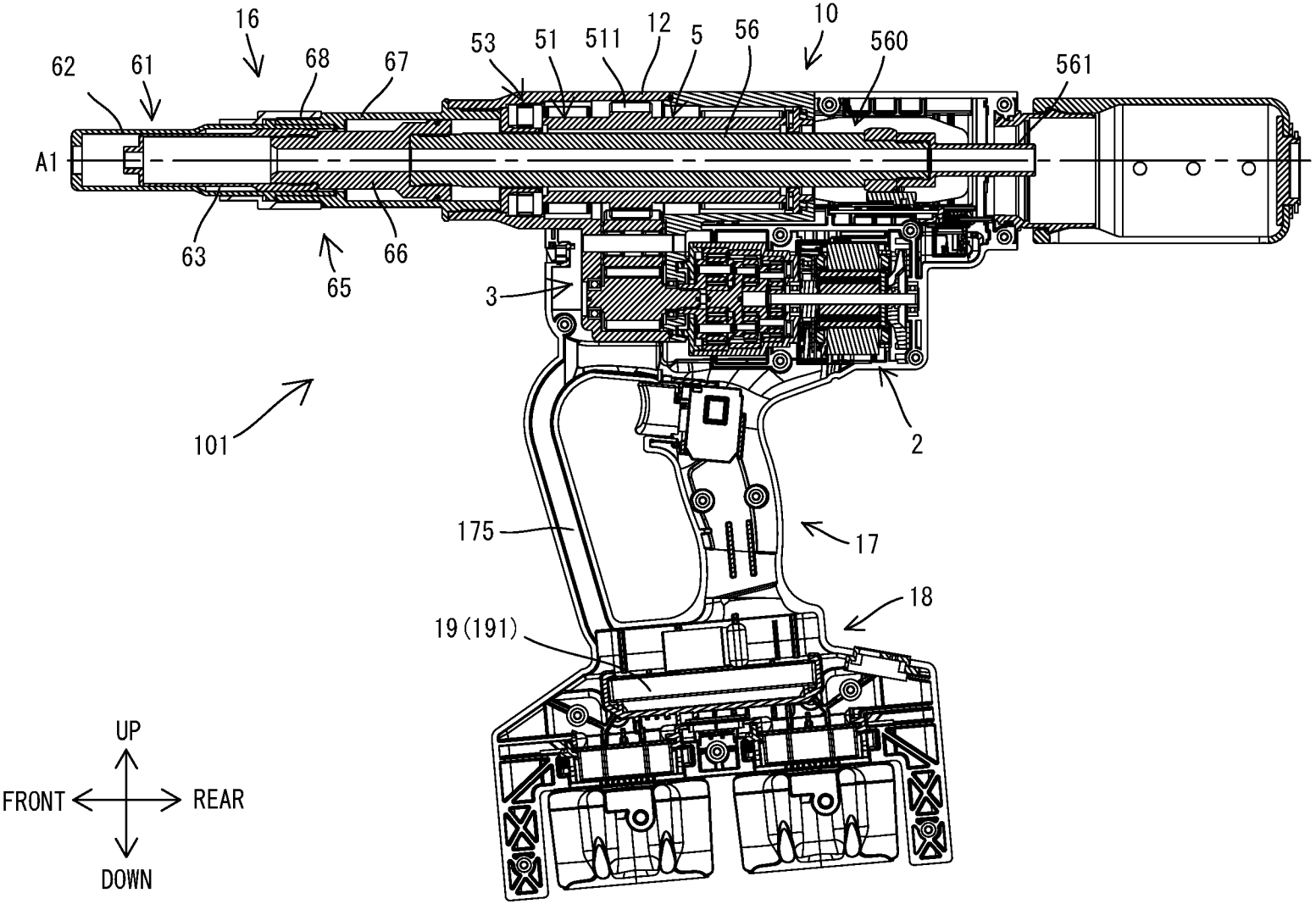
FIG. 7 is a sectional view of the fastening tool, where the screw shaft has been moved rearward from the initial position.

As shown in FIG. 7, the screw shaft 56 is moved rearward along with rotation of the nut 51. At this time, the jaw assembly 63 connected to the screw shaft 56 is retracted rearward, and the shaft part of the pin is firmly gripped by the jaw assembly 63 and pulled rearward along the driving axis A1. As a result, the collar is strongly pressed forward and radially inward and deformed, and swaged onto the shaft part. The workpieces are thus firmly clamped between the head of the pin and the collar. A strong load is required to swage the collar to the shaft part. This load is applied to the nut 51 as a forward axial force (reaction force) via the jaw assembly 63, the jaw-connecting member 66 and the screw shaft 56.

In this embodiment, however, the front-receiving part 53 shown in FIG. 6 receives the forward axial force from the nut 51 while allowing rotation of the nut 51 and transmits the axial force to the anvil-connecting sleeve 67. More specifically, the axial force from the nut 51 is transmitted to the anvil-connecting sleeve 67 via the thrust bearing 535 (the rear ring 537, the rolling elements 539, and the front ring 536) and the flange 533 of the flange sleeve 530.

As described above, the components of the thrust bearing 535 and the flange sleeve 530 are not held in contact with the first housing 12 in the axial direction (the front-rear direction). Therefore, the axial force from the nut 51 is transmitted to the anvil-connecting sleeve 67 by the front-receiving part 53, and not via the first housing 12. The manner of being transmitted "not via the first housing 12" here does not necessarily require that no axial force is transmitted via the first housing 12, but the axial force transmitted via the first housing 12 may be negligibly small compared with the axial force transmitted to the anvil-connecting sleeve 67 via the front-receiving part 53.

As described above, during a swaging operation, the forward axial force from the nut 51 is applied to the anvil-connecting sleeve 67. Meanwhile, the anvil 62 is pressed against the workpieces via the collar and receives a rearward force. Thus, a rear end surface of the locking flange 625 of the anvil 62 abuts on a frond end surface of the anvil-connecting sleeve 67 and presses the anvil-connecting sleeve 67 rearward. Therefore, the anvil 62 and the anvil-connecting sleeve 67 as a whole receives forces from opposite ends in the axial direction (the front-rear direction) which act in directions of compressing the anvil 62 and the anvil-connecting sleeve 67 as a whole. At this time, it is advantageous that the rear end surface 673 of the anvil-connecting sleeve 67 which is held in contact (surface contact) with the front end surface 534 of the flange 533 receives the force from the rear. Meanwhile, the forward axial force is not substantially applied to the first housing 12. Therefore, the front-receiving part 53 of this embodiment can reduce the possibility that forces in opposite directions are respectively applied to the female-thread part 126 of the first housing 12 and the male-thread part 672 of the anvil-connecting sleeve 67, thus resulting in loosening of the thread engagement.

Further, as described above, the female-thread part 126 and the male-thread part 672 are threaded such that their screwing direction is opposite to the direction in which the nut 51 is rotated when the screw shaft 56 is moved rearward. This can prevent loosening of the thread engagement which may otherwise be caused by rotation of the nut 51.

The operation of fastening the workpieces is completed after the collar is swaged onto the shaft part of the pin. In use of the fastening tool 101, as described above, the user specifies the operation mode which is appropriate to the type of the fastener to be used, via the operation part 187. The control circuit 191 identifies the operation mode based on a signal from the operation part 187 and stops normal rotation driving of the motor 2 at an appropriate timing according to the operation mode, and thus stops the rearward movement of the screw shaft 56. As the method of controlling to stop the rearward movement of the screw shaft 56 according to the operation mode, for example, the method disclosed in Japanese unexamined patent application publication No. 2018-103257 may be used. Thereafter, the control circuit 191 drives the motor 2 to reversely rotate to move the screw shaft 56 forward back to the initial position.

When using a shaft-retaining type fastener, a strong load is applied to the collar when the collar is swaged to the pin, so that the collar is firmly crimped to the front end portion of the bore 621 of the anvil 61. Therefore, a considerably strong load is required to move forward the jaw assembly 63 gripping the shaft part and release the collar from the anvil 62. This load is applied to the nut 51 as a rearward axial force via the jaw assembly 63, the jaw-connecting member 66 and the screw shaft 56. In this embodiment, however, the rear-receiving part 55 (the thrust bearing 551) receives the rearward axial force from the nut 51, while allowing rotation of the nut 51, and transmits the axial force to the first housing 12.

Second Embodiment

A fastening tool 102 according to a second embodiment is now described with reference to FIG. 8. The fastening tool 102 of this embodiment has substantially the same structure as the fastening tool 101 of the first embodiment, except that the fastening tool 102 has a front-receiving part 54 which is different from the front-receiving part 53 of the fastening tool 101. Therefore, structures or components which are substantially identical to those of the first embodiment are given the same numerals as in the first embodiment, and are omitted or simplified in the drawings and the following description, and different structures from the first embodiment are now mainly described. The same applies to other embodiments to follow. It is noted that, in FIG. 8, the jaw-connecting member 66 and the nose assembly 61 are not shown for convenience sake.

Figure 8:
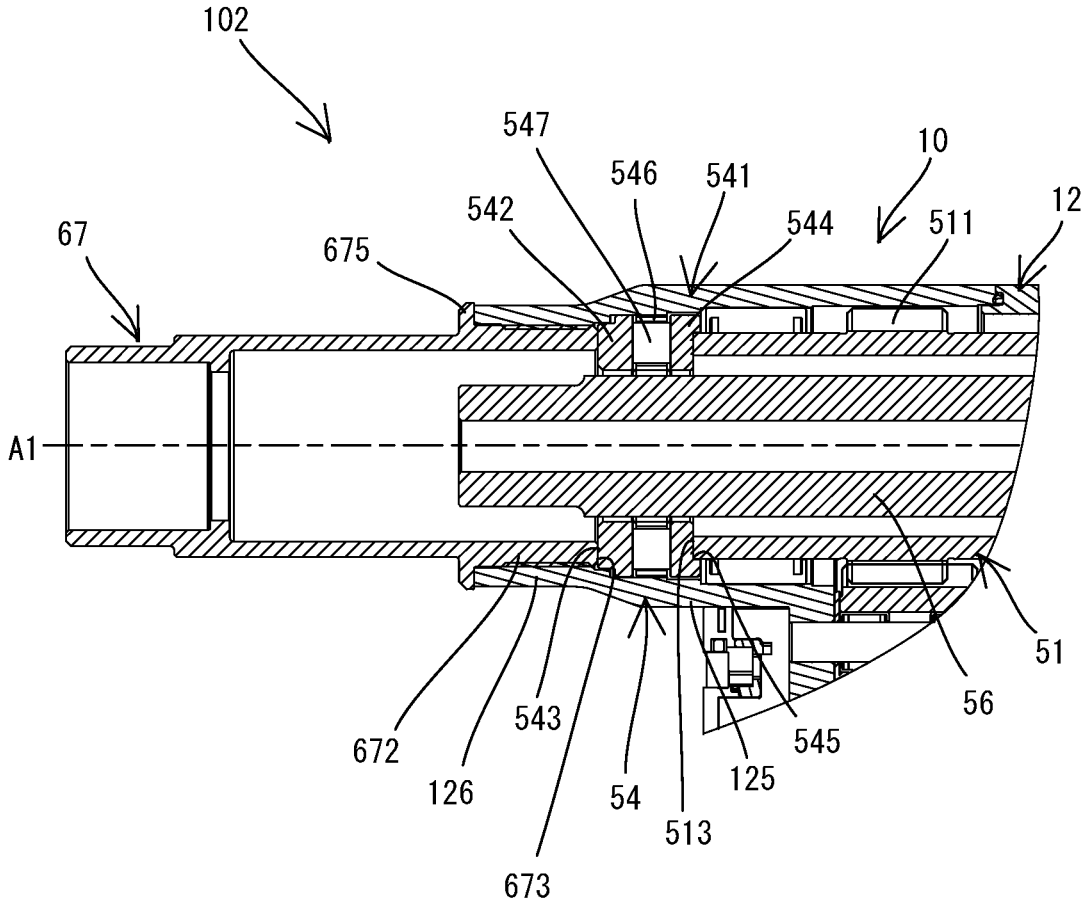
FIG. 8 is a partial sectional view of another fastening tool.

In this embodiment, as shown in FIG. 8, like in the first embodiment, the front-receiving part 54 is disposed between the rear end surface 673 of the anvil-connecting sleeve 67 and the frond end surface 513 of the nut 51 in the extending direction of the driving axis A1 (i.e. the front-rear direction). The front-receiving part 54 is configured to receive a forward axial force from the nut 51 which is generated by rearward movement of the screw shaft 56 and transmit it to the anvil-connecting sleeve 67 in a fastening process.

In this embodiment, the front-receiving part 54 includes only a thrust bearing 541. The thrust bearing 541 includes a front ring 542, a rear ring 544 and a plurality of rolling elements 547 arranged between the front ring 542 and the rear ring 544.

The front ring 542 is a fixed-side raceway ring which does not rotate together with the nut 51. The outer diameter of the front ring 542 is substantially equal to the inner diameter of the front part 125, and the inner diameter of the front ring 542 is slightly larger than the outer diameter of the screw shaft 56. The front ring 542 is positioned by being fitted in the front part 125. In this manner, the front ring 542 is held in a state in which an inner peripheral surface of the front ring 542 is spaced apart radially outward from the outer peripheral surface of the screw shaft 56. The front ring 542 is held in contact with the first housing 12 only on its outer peripheral surface (radially outer end surface) and not in contact with the first housing 12 in the axial direction (the front-rear direction). In this embodiment, the rear end surface 673 of the anvil-connecting sleeve 67 is held in contact with a front end surface 543 of the front ring 542.

A rear ring 544 is a rotation-side raceway ring which rotates together with the nut 51. The outer diameter of the rear ring 544 is smaller than the inner diameter of the front part 125, and the inner diameter of the rear ring 544 is slightly larger than the outer diameter of the screw shaft 56. A recess 545 is formed in a rear end surface of the rear ring 544. The recess 545 has substantially the same diameter as the outer diameter of the nut 51. The rear ring 544 is positioned by a front end portion of the nut 51 being fitted in the recess 545. In this manner, the rear ring 544 is held in a state in which an outer peripheral surface of the rear ring 544 is spaced apart radially inward from the inner peripheral surface of the front part 125 and also in a state in which an inner peripheral surface of the rear ring 544 is spaced apart radially outward from the outer peripheral surface of the screw shaft 56. The rear ring 544 is not held in contact with the first housing 12 not only on its outer peripheral surface (radially outer end surface) but also in the axial direction (the front-rear direction).

The rolling elements 547 are rollably held by a cage (retainer) 546 and arranged between the front ring 542 and the rear ring 544 in the front-rear direction. In this embodiment, a roller (specifically, a cylindrical roller) is also employed as the rolling element. The cage 546 is fitted in the front part 125 in a slipping state. An inner peripheral surface of the cage 546 is apart radially outward from the outer peripheral surface of the screw shaft 56.

In the fastening tool 102 of this embodiment, like in the first embodiment, the components of the front-receiving part 54, that is, the thrust bearing 541 are not held in contact with the first housing 12 in the axial direction (the front-rear direction). Therefore, the axial force from the nut 51 is transmitted to the anvil-connecting sleeve 67 by the front-receiving part 54 without being substantially transmitted via the first housing 12. This can reduce the possibility that forces in opposite directions are respectively applied to the female-thread part 126 of the first housing 12 and the male-thread part 672 of the anvil-connecting sleeve 67, thus resulting in loosening of the thread engagement.

The number of components of the front-receiving part 54 of this embodiment is reduced by omission of the flange sleeve 530, compared with the front-receiving part 53 (see FIG. 6) of the first embodiment. Further, the distance from the driving axis A1 to the upper surface of the first housing 12 (so-called center height) can be reduced by omission of the cylindrical part 531 of the flange sleeve 530 disposed between the screw shaft 56 and the first housing 12 in the radial direction.

Third Embodiment

A fastening tool 103 according to a third embodiment is now described with reference to FIG. 9. The fastening tool 103 of this embodiment has substantially the same structure as the fastening tool 101 of the first embodiment, except that the fastening tool 103 has a hand guard 176 having a different structure from the hand guard 175 of the fastening tool 101.

Figure 9:
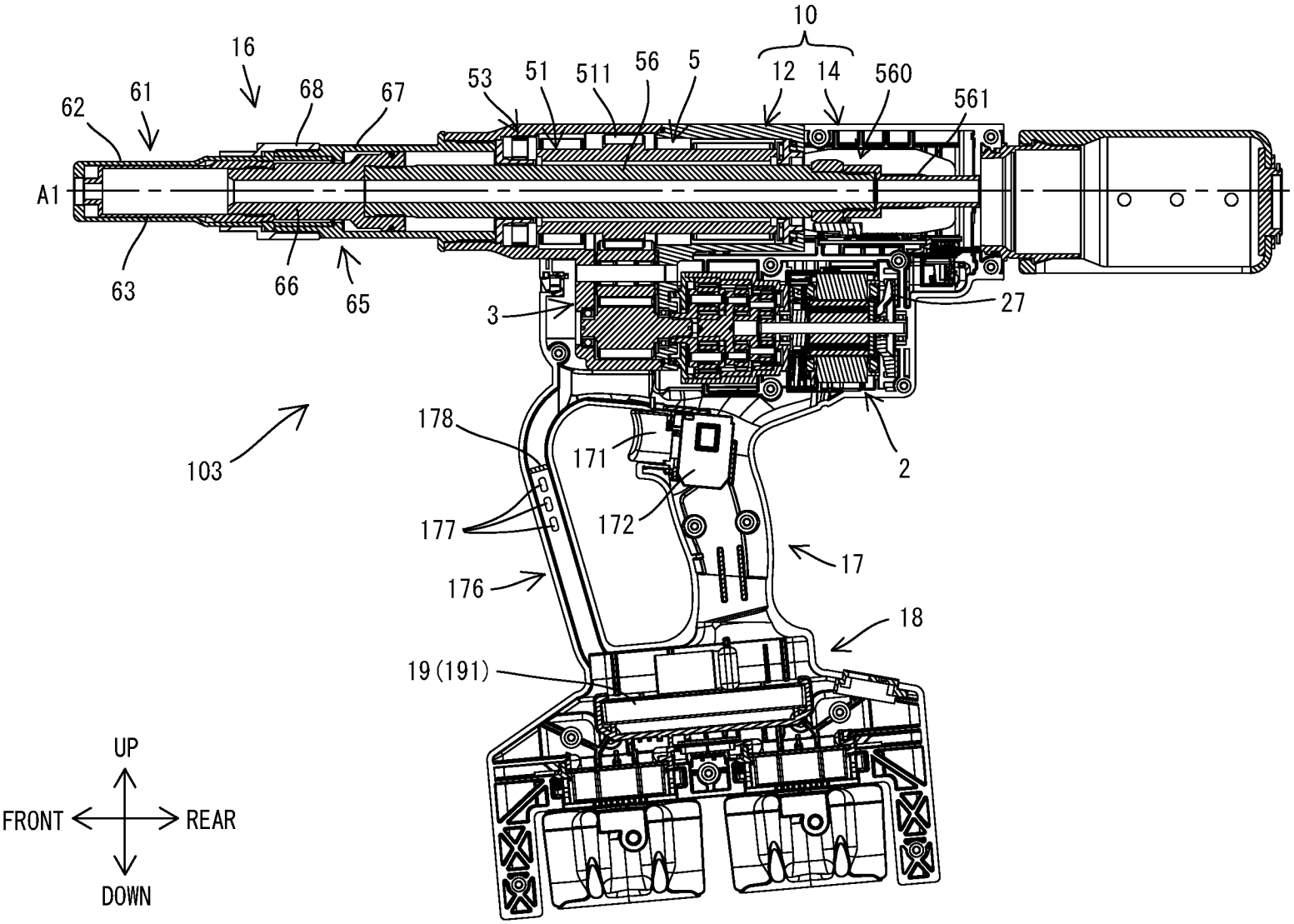
FIG. 9 is a sectional view of another fastening tool.

As shown in FIG. 9, in this embodiment, in place of the inlets 145 (see FIG. 2) which are provided in the body housing 10 (the second housing 14) in the first embodiment, a plurality of inlets 177 are provided in the cylindrical hand guard 176. Further, a partition wall 178 is provided within the hand guard 176. The partition wall 178 is provided above the inlets 177 and partitions an internal space of the hand guard 176 into a lower region where the inlets 177 are provided and an upper region which communicates with the body housing 10 (the second housing 14).

In the fastening tool 103 of this embodiment, when the motor 2 is driven and the fan 27 rotates, an air flow is generated by air flowing into the hand guard 176 from the inlets 177, passing through the inside of the battery housing 18 and the handle 17 and flowing out from the outlets 146 (see FIG. 2) of the second housing 14. Therefore, this air flow can cool not only the motor 2 but also the controller 19 housed within the battery housing 18. In this embodiment, the hand guard 176 can be effectively utilized to form a flow passage of cooling air for the motor 2 and the controller 19.

Fourth Embodiment

A fastening tool 104 according to a fourth embodiment is now described with reference to FIGS. 10 and 11. The fastening tool 104 of this embodiment has substantially the same structure as the fastening tool 101 (see FIG. 3) of the first embodiment, except that the fastening tool 104 has a planetary gear reducer 4 which is different from the planetary gear reducer 300 of the fastening tool 101. It is noted that, in FIGS. 10 and 11, as for the motor 2, only the motor shaft 23 is shown.

The planetary gear reducer 4 is coaxially arranged with the motor 2 in front of the motor 2. The planetary gear reducer 4 is a gear reducer with planetary gear mechanisms, and configured to increase torque inputted from the motor shaft 23 according to its reduction ratio and output the torque to the first intermediate shaft 31. In this embodiment, the planetary gear reducer 4 is a multi-stage planetary gear reducer. More specifically, as shown in FIG. 10, the planetary gear reducer 4 includes a gear case 40 and three sets of planetary gear mechanisms 41, 42, and 43 which are housed in the gear case 40. The gear case 40 is non-rotatably held by the body housing 10. Each of the planetary gear mechanisms 41, 42, and 43 includes a sun gear, an internal gear (also referred to as a ring gear), a carrier, and a plurality of planetary gears which are supported by the carrier and engage with the sun gear and the internal gear.

A sun gear 411 of the first-stage planetary gear mechanism 41 (i.e. the most upstream planetary gear mechanism on a power transmission path) is fixed onto a front end portion of the motor shaft 23 which serves an input shaft of the planetary gear reducer 4. An output shaft of the planetary gear reducer 4 is a carrier 433 of the third-stage planetary gear mechanism 43 (i.e. the lowermost stream planetary gear mechanism on the power transmission path).

In this embodiment, the planetary gear reducer 4 is configured such that its reduction ratio (speed reduction ratio) is variable. More specifically, the reduction ratio of the planetary gear reducer 4 can be switched between a first reduction ratio and a second reduction ratio which is larger than the first reduction ratio, along with movement of a speed-change lever 471 provided in the body housing 10. Specifically, the reduction ratio can be switched by changing engagement between gears of the gear train in the planetary gear reducer 4. The structure for switching the reduction ratio is now described in detail.

The internal gear 415 of the first-stage planetary gear mechanism 41 and the internal gear 435 of the third-stage planetary gear mechanism 43 are fixed to the gear case 40. On the other hand, the internal gear 425 of the second-stage planetary gear mechanism 42 is held by the gear case 40 so as to be rotatable and movable in the front-rear direction. A plurality of outer teeth 426 protrude radially outward from an outer periphery of a front portion of the internal gear 425. The outer gear teeth 426 are arranged at specified intervals in a circumferential direction of the internal gear 425. An annular groove 427 is formed around the entire circumference of an outer periphery of a rear portion of the internal gear 425. Further, a circular cylindrical coupling ring 401 is fixed within a front portion of the gear case 40 (specifically, behind the third-stage internal gear 435). A plurality of teeth 402 protrude radially inward from an inner periphery of the coupling ring 401. The number of the teeth 402 of the coupling ring 401 is equal to the number of the outer teeth 426 of the internal gear 425.

A switching ring 45 is mounted onto the outer periphery of the rear portion of the internal gear 425. The switching ring 45 is held by the gear case 40 so as to be non-rotatable and movable in the front-rear direction. The switching ring 45 includes a cylindrical exterior part 451 and an elongate plate-like extension piece 454 extending rearward from an upper end portion of the exterior part 451. A plurality of pins 452 are mounted to the exterior part 451 at specified intervals in the circumferential direction. Each of the pins 452 protrudes radially inward from an inner peripheral surface of the exterior part 451. Tips of the pins 452 are disposed within the annular groove 427 of the internal gear 425. A projection 455 protrudes upward from a central portion of the extension piece 454.

The speed-change lever 471 is held by the body housing 10 (specifically, a left wall) so as to be slidable in the front-rear direction. The speed-change lever 471 is partially exposed to the outside of the body housing 10 through an opening formed in the body housing 10 so that the peed-change lever 471 can be slid by a user. The speed-change lever 471 is connected to the switching ring 45 via the projection 455.

With the above-described structure, when the user slides the speed-change lever 471 in the front-rear direction, the switching ring 45 connected to the speed-change lever 471 and the internal gear 425 connected to the switching ring 45 also move in the front-rear direction. The speed-change lever 471 and the internal gear 425 can each be moved between a rearward first position (shown in FIG. 10) and a forward second position (shown in FIG. 11).

Figure 10:
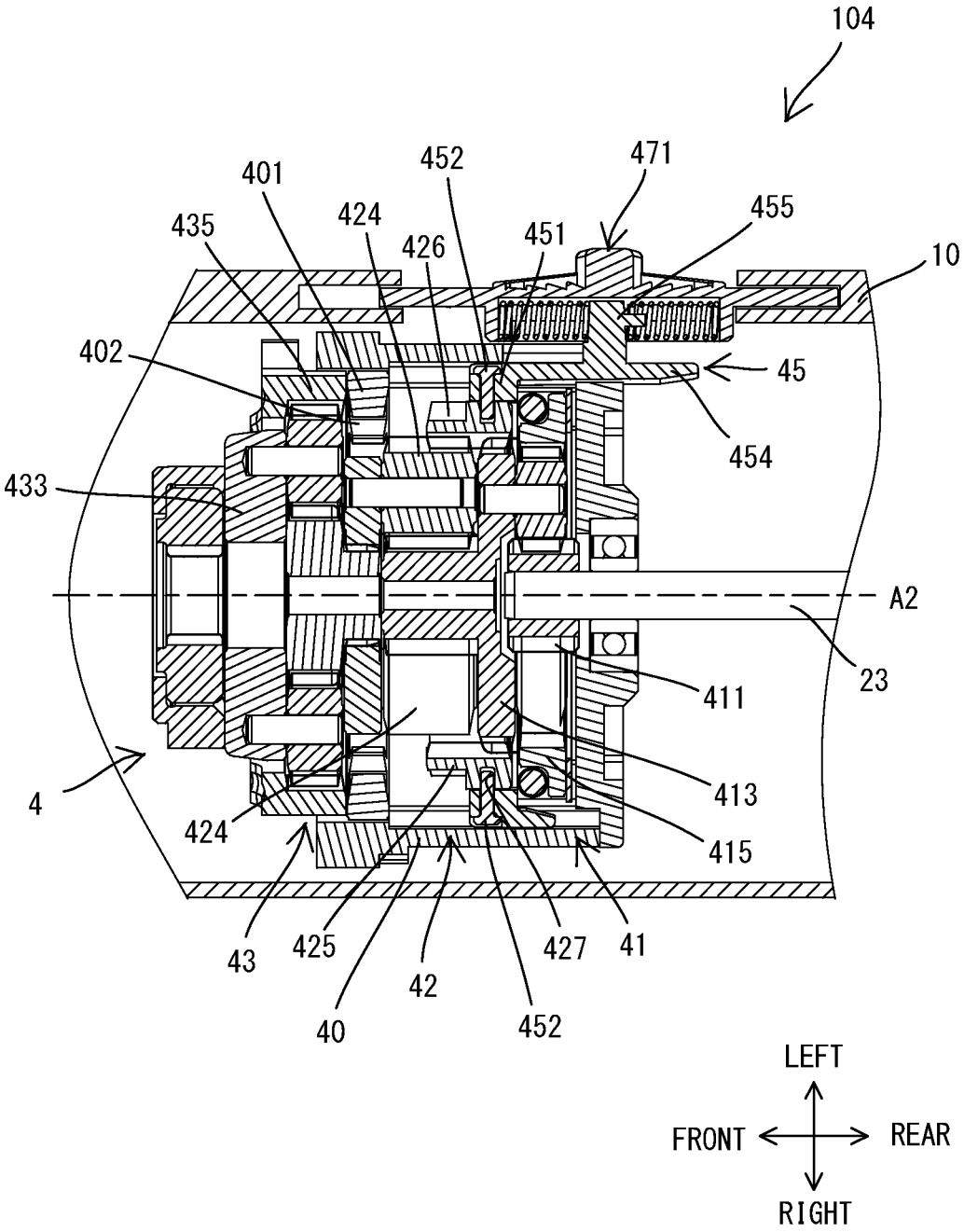
FIG. 10 is a sectional view of a planetary gear reducer with a speed-change lever placed in a first position, and its surrounding region (although a portion of a motor and a first intermediate shaft are not shown).
Figure 11:
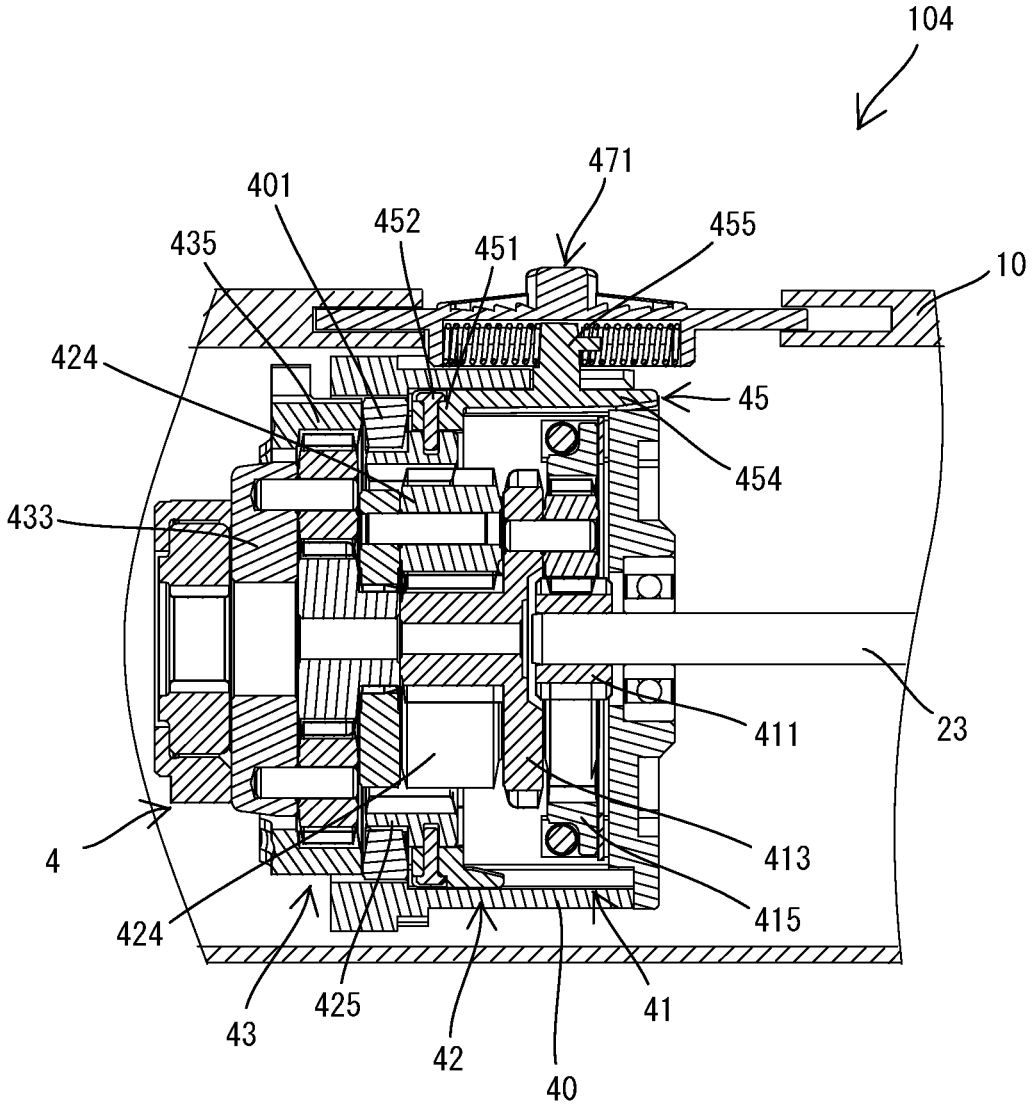
FIG. 11 is a sectional view corresponding to FIG. 10 and showing the planetary gear reducer with the speed-change lever switched to a second position.

As shown in FIG. 10, when the speed-change lever 471 and the internal gear 425 are placed in the first position, the internal gear 425 engages with the carrier 413 of the first-stage planetary gear mechanism 41 while maintaining engagement with the planetary gears 424 of the second-stage planetary gear mechanism 42. Thus, the speed reducing function of the second-stage planetary gear mechanism 42 is disabled, so that two stages of the planetary gear reducer 4 are effective (two planetary gear mechanisms can effectively function). On the other hand, as shown in FIG. 11, when the speed-change lever 471 and the internal gear 425 are placed in the second position, the internal gear 425 is apart from the carrier 413 while maintaining engagement with the planetary gears 424. Further, the outer teeth 426 of the front portion of the internal gear 425 engage with the teeth 402 of the coupling ring 401. As a result, the speed reducing function of the second-stage planetary gear mechanism 42 is enabled, so that three stages of the planetary gear reducer 4 are effective.

As described above, in this embodiment, the reduction ratio of the planetary gear reducer 4 can be changed by changing the number of effective stages of the planetary gear reducer 4. Specifically, a second reduction ratio when the internal gear 425 is placed in the second position is larger than a first reduction ratio when the internal gear 425 is placed in the first position. Therefore, larger torque can be outputted from the planetary gear reducer 4 when the internal gear 425 is placed in the second position than when the internal gear 425 is placed in the first position. Further, the rotation speed of the nut 51 and thus the moving speed of the screw shaft 56 are higher when the internal gear 425 is placed in the first position than when the internal gear 425 is placed in the second position.

An operation of fastening workpieces by using the fastening tool 104 is now described.

First, a user attaches to the fastening tool 104 the nose assembly 61 which is appropriate to a fastener to be used (the fastener 8 shown in FIG. 1 or another fastener). Further, the user selects an appropriate reduction ratio by sliding the speed-change lever 471 according to the fastener and/or the workpieces to be used. A suitable force for pulling the pin with the jaw assembly (pin-gripping part) 63 can vary, for example, depending on the materials of the fastener and the workpieces and the thickness of the shaft part of the pin. Therefore, in a case where a relatively large pulling force is required, the user may place the speed-change lever 471 and the internal gear 425 in the second position (shown in FIG. 11). On the other hand, in a case where only a relatively small pulling force is required, the user may place the speed-change lever 471 and the internal gear 425 in the first position (shown in FIG. 10). In this manner, the torque to be outputted from the planetary gear reducer 4 and thus the pulling force of the jaw assembly 63 connected to the screw shaft 56 may be adjusted. Further, the rotation speed of the nut 51 and thus the moving speed of the screw shaft 56 may also be adjusted. The subsequent fastening operation is as described in the first embodiment.

As described above, the fastening tool 104 of this embodiment includes the body housing 10, the anvil 62, the jaw assembly 63, the motor 2 and the driving mechanism 3. The body housing 10 extends along the driving axis A1 in the front-rear direction. The anvil 62 is held by the body housing 10 such that the anvil 62 can abut on the collar of the fastener. The jaw assembly 63 is configured to grip a portion of the pin of the fastener and held to be movable along the driving axis A1 relative to the anvil 62. The driving mechanism 3 includes the screw shaft 56 connected to the jaw assembly 63 via a connecting member 651. The driving mechanism 3 is configured to convert rotational motion of the motor 2 into linear motion of the screw shaft 56 and move the jaw assembly 63 along the driving axis A1 relative to the anvil 62.

Further, the driving mechanism 3 includes the planetary gear reducer 4 provided on the transmission path from the motor 2 to the screw shaft 56. The planetary gear reducer 4 is relatively small in size and capable of providing a relatively large reduction ratio, compared with a gear reducer with a combination of spur gears or other gears. Further, the planetary gear reducer 4 is capable of changing the reduction ratio and thus the torque to be outputted from the planetary gear reducer 4, along with sliding movement of the speed-change lever 471 in the front-rear direction which is externally operated by a user. More specifically, while sliding, the speed-change lever 471 moves the second-stage internal gear 425 in the axial direction via the switching ring 45 connected to the speed-change lever 471, thereby changing the number of the effective stages of the planetary gear reducer 4.

Therefore, the user can easily change the force of pulling the pin with the jaw assembly 63 by simply sliding the speed-change lever 471, for example, depending on the materials and specifications of the fastener and the workpieces to be used. In a case in which the force of pulling the pin is changed by changing the reduction ratio of the planetary gear reducer 4, the control circuit 191 need not control the rotation speed of the motor 2 in order to change the reduction ratio. This allows the control circuit 191 to drive the motor 2 with high efficiency at all times.

Further, the maximum pulling force the fastening tool 104 can exert (the pulling force when the second reduction ratio is set) depends on the specifications of the motor 2. However, there may be a case in which a pulling force as large as the maximum pulling force may not be needed, depending on the fastener or the workpieces to be used. In such a case, by setting the reduction ratio to the first reduction ratio, which is smaller than the second reduction ratio, the rotation speed of the motor 2 can be held uniform, but, via the planetary gear reducer 4, the nut 51 can be rotated at higher speed and thus the screw shaft 56 can be moved at higher speed while the torque is suppressed. In this manner, the fastening tool 104 can realize shortening of work time required to fasten one fastener while exerting the minimum torque required. Particularly, when fastening a number of fasteners, overall work time can be significantly shortened, so that working efficiency can be improved.

Fifth Embodiment

A fastening tool 105 according to a fifth embodiment is now described with reference to FIGS. 12 and 13. The fastening tool 105 of this embodiment has substantially the same structure as the fastening tool 104 of the fourth embodiment, except that a structure for changing the number of effective stages of the planetary gear reducer 4 is different from that of the fastening tool 104 of the fourth embodiment.

In the fourth embodiment, the number of effective stages of the planetary gear reducer 4 can be changed along with movement of the speed-change lever 471, which is externally operated by a user. In this embodiment, however, the number of effective stages of the planetary gear reducer 4 can be changed by a solenoid 48 according to information inputted via the operation part 187 (see FIG. 3).

Figure 12:
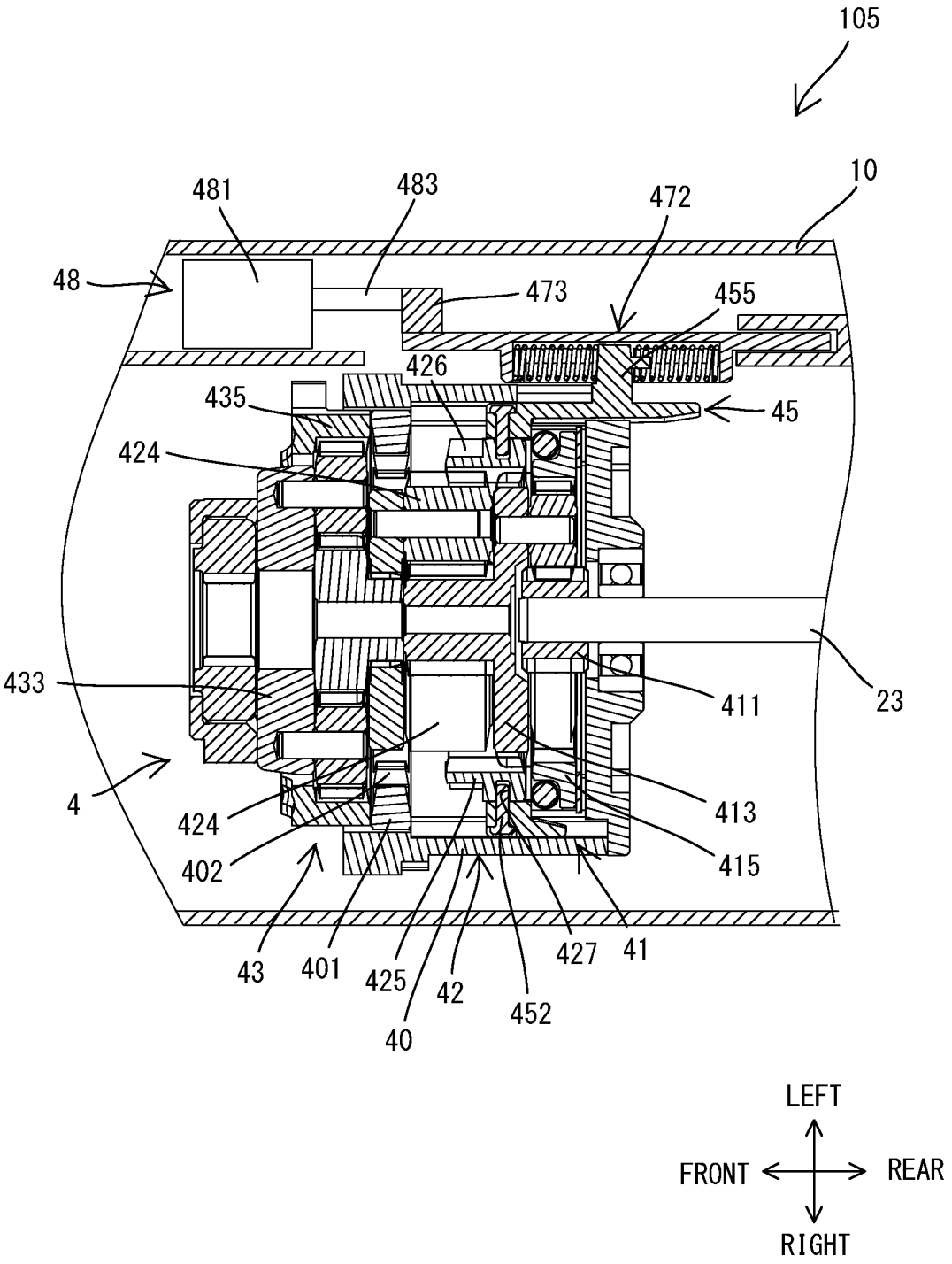
FIG. 12 is a sectional view of another planetary gear reducer with a speed-change lever placed in a first position, and its surrounding region.
Figure 13:
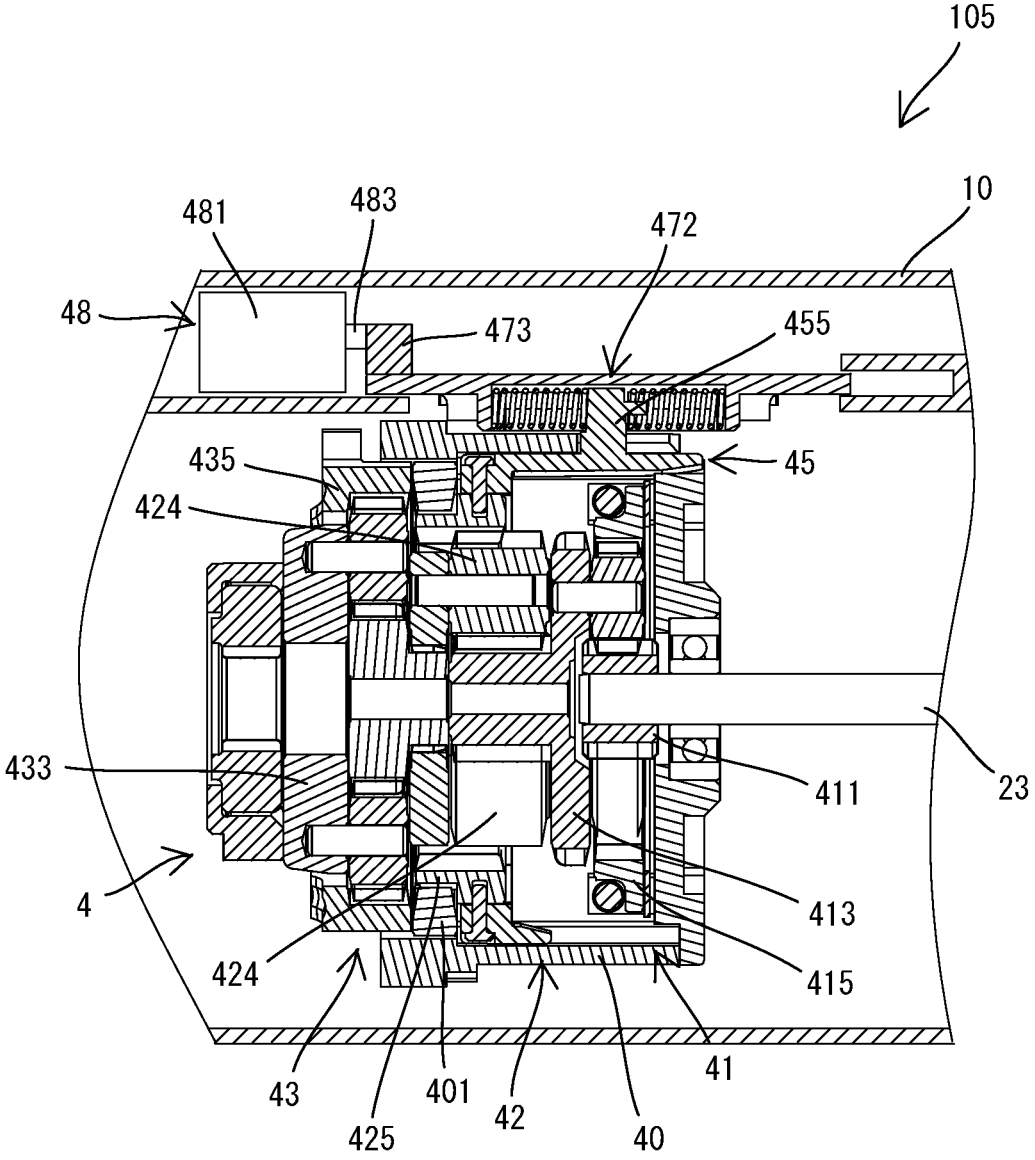
FIG. 13 is a sectional view corresponding to FIG. 12 and showing the planetary gear reducer with the speed-change lever switched to a second position.

As shown in FIG. 12, in this embodiment, the switching ring 45 is connected to the internal gear 425 of the planetary gear reducer 4 via the pins 452 and to an interlocking member 472. The interlocking member 472 has substantially the same structure as the speed-change lever 471 (see FIG. 10) of the fourth embodiment, and is held within the body housing 10 so as to be movable in the front-rear direction. Unlike the speed-change lever 471, however, the entire interlocking member 472 is housed within the body housing 10, and is not designed to be externally operated by a user. A projection 473 protrudes to the left from a front end portion of the interlocking member 472. Like the speed-change lever 471, the interlocking member 472 can move together with the internal gear 425 between a rearward first position (shown in FIG. 12) and a forward second position (shown in FIG. 13).

The solenoid 48 is supported in front of the interlocking member 472 by the body housing 10. Although not shown in detail, the solenoid 48 is a known electrical component which is configured to convert electric energy into mechanical energy of linear motion by utilizing a magnetic field generated by energizing a coil. The solenoid 48 includes a case 481, a coil (not shown) housed in the case 481, and a plunger 483 which is configured to operate in response to activation of the solenoid 48 (energization to the coil). The solenoid 48 is arranged such that the plunger 483 protrudes rearward from the case 481. A rear end of the plunger 483 is connected to the projection 473 of the interlocking member 472.

The solenoid 48 is electrically connected to the control circuit 191 (see FIG. 3) of the controller 19 by wiring (not shown). In this embodiment, when selecting the reduction ratio, a user may press one of the push-button switches of the operation part 187 which corresponds to the type of the fastener and/or the workpieces to be used.

The control circuit 191 is configured to control activation of the solenoid 48 based on a signal from the operation part 187. When the solenoid 48 is not activated (the coil is not energized), the plunger 483 holds (places) the interlocking member 472 and the internal gear 425 in the first position shown in FIG. 12. At this time, two stages of the planetary gear reducer 4 are effective and the smaller first reduction ratio is set. On the other hand, when the solenoid 48 is activated, the plunger 483 moves forward to place the interlocking member 472 and the internal gear 425 in the second position shown in FIG. 13. At this time, three stages of the planetary gear reducer 4 are effective and the larger second reduction ratio is set. In this manner, like in the fourth embodiment, the torque to be outputted from the planetary gear reducer 4 and thus the pulling force of the jaw assembly 63 connected to the screw shaft 56 can be adjusted.

As described above, the fastening tool 105 of this embodiment includes the operation part 187 (switches) through which information may be inputted, in response to an external operation of a user. Further, the planetary gear reducer 4 is configured to change the reduction ratio based on information (information relating to the type of the fastener and/or the workpieces) inputted via the operation part 187. More specifically, the control circuit 191 of the controller 19 can appropriately activate the solenoid 48 based on inputted information so as to move the second-stage internal gear 425 in the axial direction via the plunger 483 and thereby change the number of effective stages of the planetary gear reducer 4. Therefore, the user can easily change the force of pulling the pin with the jaw assembly 63 by simply operating the operation part 187, for example, depending on the materials or specifications of the fastener and the workpieces to be used.

Sixth Embodiment

A fastening tool 106 according to a sixth embodiment is now described with reference to FIG. 14. The fastening tool 106 of this embodiment is different from the fastening tool 105 of the fifth embodiment in that the fastening tool 106 further includes a temperature sensor 49 and the control circuit 191 is configured to control the solenoid 48 (see FIG. 12) based on a detection result of the temperature sensor 49.

Figure 14:
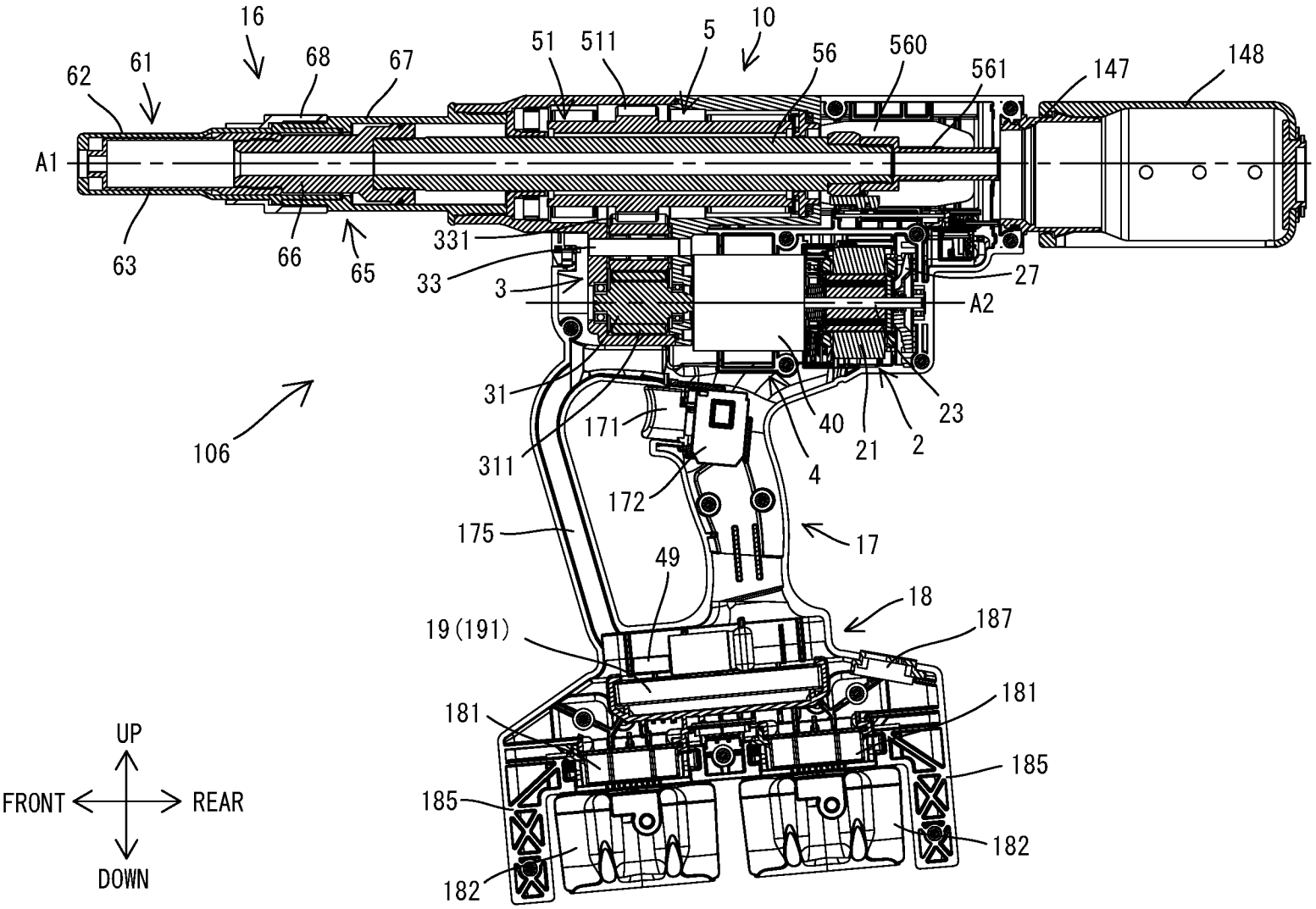
FIG. 14 is a sectional view of another fastening tool.

As shown in FIG. 14, the temperature sensor 49 is disposed in the vicinity of the controller 19 within the battery housing 18. The temperature sensor 49 is electrically connected to the control circuit 191 by wiring (not shown) and configured to output a signal indicating measured temperature to the control circuit 191.

The control circuit 191 is configured to control the solenoid 48 based on the signal from the temperature sensor 49. Specifically, in a case where the measured temperature exceeds a threshold, the control circuit 191 activates the solenoid 48 to place the interlocking member 472 and the internal gear 425 in the second position (shown in FIG. 13) corresponding to the larger second reduction ratio. On the other hand, in a case where the measured temperature does not exceed the threshold, the control circuit 191 does not activate (or stops energization) the solenoid 48 to place the interlocking member 472 and the internal gear 425 in the first position (shown in FIG. 12) corresponding to the smaller first reduction ratio. In this manner, like in the fourth embodiment, the torque to be outputted from the planetary gear reducer 4 and thus the pulling force of the jaw assembly 63 connected to the screw shaft 56 can be adjusted. Further, the rotation speed of the nut 51 and thus the moving speed of the screw shaft 56 can also be adjusted.

As described above, the fastening tool 106 of this embodiment has the temperature sensor 49 which is configured to measure the temperature in the vicinity of the controller 19. The planetary gear reducer 4 is capable of changing the reduction ratio based on the temperature measured by the temperature sensor 49. More specifically, in a case where the measured temperature exceeds the threshold, the control circuit 191 activates the solenoid 48 to switch the reduction ratio of the planetary gear reducer 4 to the larger second reduction ratio. In a case where the temperature exceeds the threshold, heat generation from the controller 19 (e.g. the control circuit 191 and the driving circuit for the motor 2) is increased to some extent and relatively large load is applied to the controller 19. In such a case, load on the controller 19 can be reduced by increasing the torque outputted from the planetary gear reducer 4. Further, when the measured temperature decreases to the threshold or less again, the control circuit 191 may stop energization to the solenoid 48 and change the reduction ratio of the planetary gear reducer 4 to the smaller first reduction ratio. In this manner, the rotation speed of the nut 51 and thus the moving speed of the screw shaft 56 can be increased, so that excellent working efficiency can be maintained.

Seventh Embodiment

A fastening tool 107 according to a seventh embodiment is now described with reference to FIG. 15. The fastening tool 107 of this embodiment is different from the fastening tool 105 of the fifth embodiment in that the fastening tool 107 further includes a current-detection circuit 193 and the control circuit 191 is configured to control the solenoid 48 based on a detection result of the current-detection circuit 193.

At an early stage of the process of fastening the workpieces with the fastener, load is small and large torque is not required. As the operation of swaging the collar to the pin progresses, however, load increases and larger torque is required. Therefore, in this embodiment, the reduction ratio is changed according to load. Specifically, the magnitude of the current flowing to the motor 2 is used as the magnitude of load.

Figure 15:
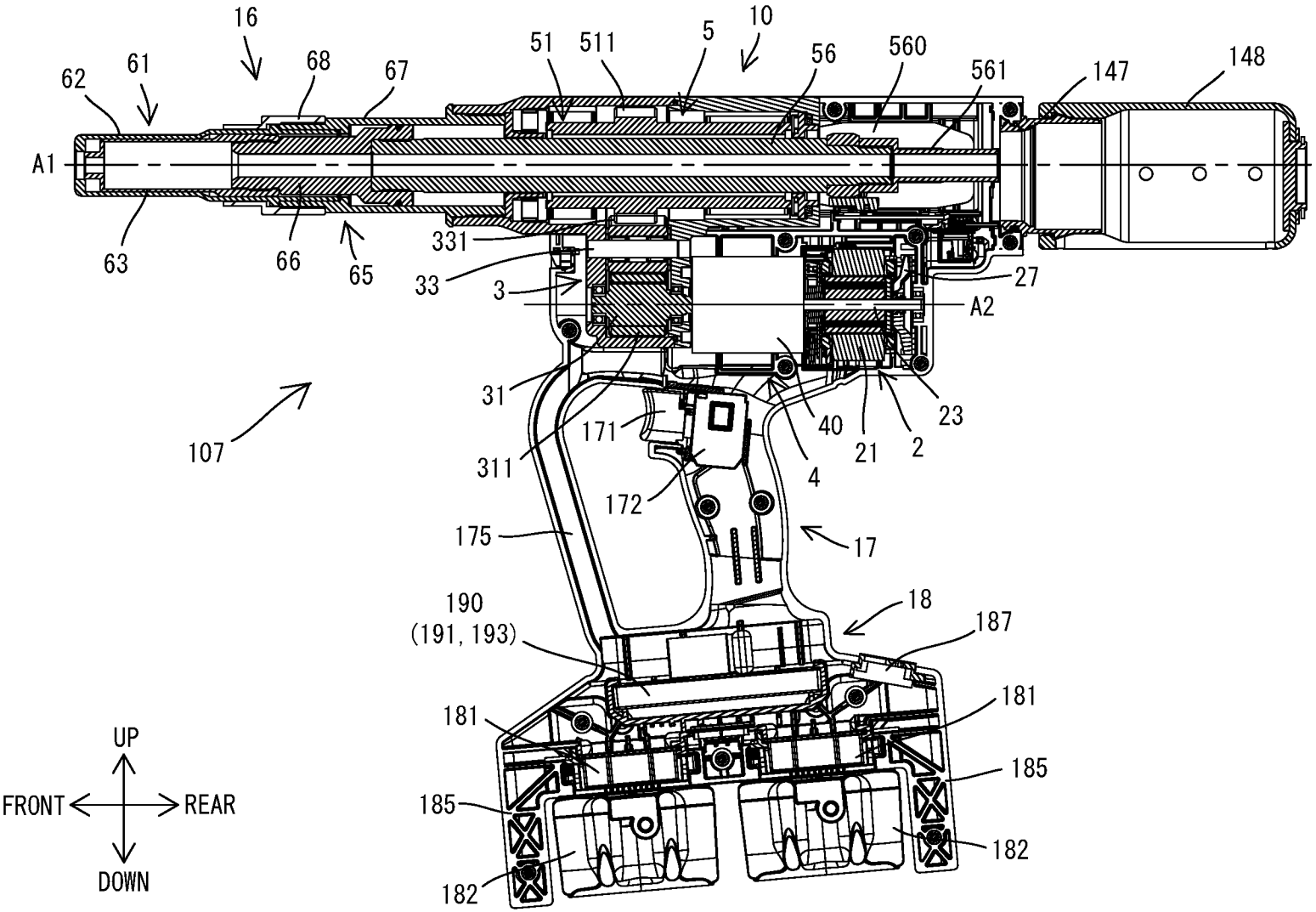
FIG. 15 is a sectional view of another fastening tool.

For this purpose, as shown in FIG. 15, the controller 19 of this embodiment includes a current-detection circuit 193 for detecting the magnitude of the current flowing to the motor 2. In this embodiment, the current-detection circuit 193 is configured to detect a current flowing to the motor 2 via a resistance provided in an energizing path to the motor 2, but any known method may be adopted to detect the current flowing to the motor 2. The current-detection circuit 193 is mounted on the circuit board together with the control circuit 191 and electrically connected to the control circuit 191. The current-detection circuit 193 is configured to output a signal indicating the magnitude of the detected current to the control circuit 191.

The control circuit 191 is configured to control the solenoid 48 based on the signal from the current-detection circuit 193. Specifically, in a case where the magnitude (current value) of the detected current does not exceed a threshold, the control circuit 191 does not activate (or stop energization to) the solenoid 48 to place the interlocking member 472 and the internal gear 425 in the first position (shown in FIG. 12) corresponding to the smaller first reduction ratio. On the other hand, in a case where the detected current value exceeds the threshold, the control circuit 191 activates the solenoid 48 to place the interlocking member 472 and the internal gear 425 in the second position (shown in FIG. 13) corresponding to the larger second reduction ratio. In this manner, like in the fourth embodiment, the torque to be outputted from the planetary gear reducer 4 and thus the pulling force of the jaw assembly 63 connected to the screw shaft 56 can be adjusted. Further, the rotation speed of the nut 51 and thus the moving speed of the screw shaft 56 can also be adjusted.

As described above, in the fastening tool 107 of this embodiment, the planetary gear reducer 4 is capable of changing the reduction ratio based on the magnitude of the current flowing to the motor 2 which is detected by the current-detection circuit 193. More specifically, at the early stage of the fastening process, while load is relatively small and the current value does not exceed the threshold, the control circuit 191 does not activate the solenoid 48 and adopts the first reduction ratio, so that the screw shaft 56 is moved at higher speed while the torque is suppressed. When load increases to some extent with progress of the swaging operation and the current value exceeds the threshold, the control circuit 191 activates the solenoid 48 to change the reduction ratio to the larger second reduction ratio, so that the torque is increased while the moving speed of the screw shaft 56 is reduced. Further, when the collar is swaged to the pin and the operation of fastening the workpieces is completed, load decreases and the current value decreases to the threshold or less again, the control circuit 191 stops energization to the solenoid 48 and changes the reduction ratio to the first reduction ratio, so that the screw shaft 56 is returned to the initial position at higher speed while the torque is suppressed. In this manner, in this embodiment, the screw shaft 56 can be moved at higher speed while load is relatively small at the early stage of the fastening process and after completion of the operation of fastening the workpieces, so that work time can be shortened and working efficiency can be improved.

Correspondences between the features of the embodiments and the features of the invention are as follows. However, the features of the above-described embodiments are merely exemplary and do not limit the features of the invention. Each of the fastening tools 101 to 107 is an example of the "fastening tool". The fastener 8, the pin 81 and the collar 85 are examples of the "fastener", the "pin" and the "cylindrical part", respectively. The driving axis A1 is an example of the "first axis". The body housing 10 is an example of the "housing". The handle 17 is an example of the "handle". The anvil 62 is an example of the "anvil". The jaw assembly 63 is an example of the "pin-gripping part". The motor 2 is an example of the "motor". The driving mechanism 3 is an example of the "driving mechanism". The nut 51 and the driven gear 511 are examples of the "rotary member" and the "driven gear", respectively. The screw shaft 56 is an example of the "movable member". The rotation axis A2 is an example of the "second axis". The nut-driving gear 311 is an example of the "driving gear". The idler gear 331 is an example of the "idler gear".

The planetary gear reducer 300 is an example of the "planetary gear reducer". The first housing 12 is an example of the "first housing". The second housing 14 is an example of the "second housing". The speed-reducer assembly 30 is an example of the "speed-reducer assembly". The sealing member (O-ring) 137 is an example of the "sealing member". The motor region 141 and the shaft region 142 are examples of the "first region" and the "second region", respectively. The partition wall 143 is an example of the "partition wall". Each of the inlet 145 and the outlet 146 is an example of the "opening". The battery-mounting part 181 is an example of the "battery-mounting part"

The above-described embodiments are mere examples and the fastening tool according to the present invention is not limited to the fastening tools 101 to 107 of the above-described embodiments. For example, the following modifications may be made. At least one of these modifications can be employed in combination with at least one of any of the fastening tools 101 to 107 of the above-described embodiments or the claimed invention.

For example, the fastening tools 101 to 107 are each configured to be selectively used with plural kinds of multi-piece swage type fasteners by replacing the nose assembly 61. Further, the fastening tools 101 to 107 may be used with a known fastener of a type which is referred to as a blind rivet (or rivet), by replacing the nose assembly 61. The blind rivet includes a pin and a cylindrical part (also referred to as a sleeve or a rivet body) which are formed integrally with each other. In the blind rivet, like in a tear-off multi-piece swage type fastener, a pintail is torn off in a fastening process.

Alternatively, the fastening tools 101 to 107 may be configured as a tool designed specifically for any one of a tear-off multi-piece swage type fastener, a shaft-retaining multi-piece swage type fastener and a blind rivet. In this case, the structures of the body housing 10 and the driving mechanism 3 and the controlling manner of the control circuit 191 may be appropriately changed, according to the type of the fastener. For example, in a fastening tool designed specifically for a shaft-retaining multi-piece swage type fastener, a pintail is not separated, so that a passage for the pintail formed in the screw shaft 56 and the container 148 may be omitted. In a fastening tool designed specifically for a tear-off multi-piece swage type fastener or a blind rivet, the thrust bearing 551 disposed behind the nut 51 may be omitted.

The structures and materials of the nose assembly 61 (the anvil 62 and the jaw assembly 63) and the nose adapter 65 (the anvil-connecting sleeve 67, the jaw-connecting member 66, the fixing ring 68) may be appropriately changed.

For example, the shape of the anvil 62 and the manner of connecting the anvil 62 to the body housing 10 may be changed. The shape of the anvil-connecting sleeve 67 can be appropriately changed according to the shape of the anvil 62. Further, the anvil 62 may be threadedly engaged with the female-thread part 126 directly and not via the anvil-connecting sleeve 67. In this case, the rear end portion of the anvil 62 may be formed like the male-thread part 672.

Similarly, the shape of the jaw assembly 63 and the manner of connecting the jaw assembly 63 to the screw shaft 56 may be changed. The jaw assembly 63 may be connected to the screw shaft 56 directly and not via the jaw-connecting member 66. The jaw assembly 63 may be configured such that the force of the claws gripping the pin varies as the claws move in the radial direction along with movement of the jaw assembly 63 relative to the anvil 62 in the front-rear direction. For example, the shape and number of the claws may be appropriately changed.

The structures of the front-receiving parts 53, 54 may be appropriately changed. For example, the front ring 536 of the thrust bearing 535 may be omitted and the flange 533 of the flange sleeve 530 may also serve as a raceway ring. The rear ring 537 of the thrust bearing 535 and the rear ring 544 of the thrust bearing 541 may be integrated with the nut 51. Balls may be employed, in place of the rollers, as the rolling elements 539, 547. Further, a member (such as a washer) (other than the front-receiving part 53, 54) which is not held in contact with the first housing 12 in the axial direction (the front-rear direction) may be additionally arranged between the rear end surface 673 of the anvil-connecting sleeve 67 and the frond end surface 513 of the nut 51. The structure of the thrust bearing 551 of the rear-receiving part 55 may also be similarly changed.

The structures and arrangement of the motor 2, the driving mechanism 3, the controller 19 and the operation part 187 may be appropriately changed.

For example, a motor with a brush may be employed, in place of the brushless motor. Further, an alternate current (AC) motor which is driven by power supplied from an external AC power source may be employed as the motor 2. In the above-described embodiments, the motor body 21 is disposed rearward of the rear end of the nut 51 in the front-rear direction. However, like the planetary gear reducer 300, the motor body 21 may be at least partially disposed directly below the nut 51 (specifically, a portion of the nut 51 extending rearward of the driven gear 511). Further, the motor 2 need not be coaxially arranged with the planetary gear reducer 300 and the first intermediate shaft 31. For example, the rotation axis A2 of the motor shaft 23 may be parallel to the axis of the planetary gear reducer 300 and the first intermediate shaft 31. The motor 2 may be arranged such that the rotation axis A2 of the motor shaft 23 crosses the driving axis A1.

In the driving mechanism 3, a feed-screw mechanism including a nut and a screw shaft directly engaged with the nut may be employed, in place of the ball-screw mechanism 5. The number of the stages of the planetary gear reducer 300 (i.e. the number of the planetary gear mechanisms included in the planetary gear reducer 300) and the structure of the planetary gear mechanism in each stage may be appropriately changed. For example, the planetary gear reducer 300 may include two or four or more planetary gear mechanisms. In place of the planetary gear reducer 300, a gear reducer including a gear train (a train of spur gears, helical gears, or bevel gears, for example) other than a planetary gear mechanism may be arranged between the motor 2 and the nut-driving gear 311 on the power transmission path.

The controller 19 may be housed in the body housing 10 rather than in the battery housing 18. Further, in the above-described embodiments, the control circuit 191 is formed by a microcomputer including a CPU. However, the control circuit 191 may be formed, for example, by a programmable logic device such as an ASIC (Application Specific Integrated Circuit) and an FPGA (Field Programmable Gate Array).

The input device used to input information for specifying the operation mode is not limited to the push-button switches of the operation part 187, but it may be, for example, a slide switch, a rotary dial or a touch panel. Information to be inputted from the operation part 187 is not limited to information relating to the operation mode. For example, it may be information relating to the type of the fastener and/or the workpieces, desired pulling force, a moving speed of the screw shaft 56 (pulling speed) and an environmental temperature. Further, the operation part 187 may be provided in another position (for example, on the body housing 10), or it may be omitted.

The structures, positions and materials of the body housing 10, the handle 17, the hand guards 175, 176 and the battery housing 18 may be appropriately changed.

For example, the first housing 12 and the second housing 14 may be integrally formed with each other. The first housing 12 and the second housing 14 may respectively have different shapes. The speed-reducer assembly 30 does not need to be removable from the first housing 12. Specifically, the gear-reducer case 13 may be integrally formed with the first housing 12. The first housing 12 may be formed by connecting a plurality of parts different from those of the above-described embodiments. Similarly, the second housing 14 does not need to be formed of resin integrally with the handle 17, the hand guard 175 or 176 and the battery housing 18. At least one of these parts may be separately formed and connected to the other parts with screws or the like. The hand guard 175, 176 may be omitted.

The number of the battery-mounting parts 181 (i.e. the number of the batteries 182 which can be mounted) may be one or three or more. Further, the position of the battery-mounting parts 181 is not limited to the lower portion of the battery housing 18. The battery guards 185 may be omitted.

Further, in view of the nature of the present invention and the above-described embodiments, the following features are provided. At least one of the following features can be employed in combination with at least one of the above-described embodiments, their modifications and the claimed invention.

Aspect 1

The idler gear is rotatable around a third axis, and the third axis extends in parallel to the first and second axes between the first and second axes in the up-down direction.

The rotation axis A3 is an example of the "third axis" according to this aspect.

Aspect 2

The first, second and third axes are arranged on a same plane.

Aspect 3

The second housing has an opening which provides communication between an outside of the second housing and the first region, and the opening serves as an inlet or an outlet for cooling air for the motor.

Each of the inlet 145 and the outlet 146 is an example of the "opening" according to this aspect.

Aspect 4

The fastening tool further includes a plurality of battery-mounting parts, each of the plurality of battery-mounting parts being configured to removably receive a battery, and the battery-mounting parts are arranged side by side in the front-rear direction below the handle.

The battery-mounting part 181 is an example of the "battery-mounting part" according to this aspect.

Aspect 5

The second housing houses at least a portion of the first housing.

Aspect 6

The second housing houses the gear-reducer case.

Further, following Aspects 7 to 20 are provided for the purpose of providing improvement of a receiving part in a fastening tool configured to fasten workpieces via a fastener having a pin and a cylindrical part, wherein the receiving part is configured to receive a reaction force generated when the pin is pulled. Any one of Aspects 7 to 20 can be employed independently, or in combination with at least one of the other aspects. Alternatively, at least one of Aspects 7 to 20 can be employed in combination with at least one of the fastening tools 101 to 107 of the above-described embodiments, the above-described modifications and aspects and the claimed invention.

Aspect 7

A fastening tool configured to fasten workpieces via a fastener having a pin and a cylindrical part, the fastening tool comprising:

a housing extending along a driving axis, the driving axis defining a front-rear direction of the fastening tool;

an anvil configured to abut on the cylindrical part of the fastener, the anvil being connected to a front end portion of the housing so as to extend along the driving axis, by being directly threadedly engaged with the housing, or via a connecting member threadedly engaged with the housing;

a pin-gripping part configured to grip the pin and held to be movable along the driving axis relative to the anvil;

a motor housed in the housing;

a rotary member supported by the housing so as to be rotatable around the driving axis, the rotary member being configured to be rotationally driven by power of the motor;

a movable member connected to the pin-gripping part, the movable member being engaged with the rotary member and configured to be linearly moved in the front-rear direction when the rotary member is rotationally driven; and a receiving part disposed between the rotary member and the anvil or between the rotary member and the connecting member in the front-rear direction, the receiving part being configured to receive a forward axial force applied from the rotary member and not via the housing, and transmit the axial force to the anvil or the connecting member, the forward axial force being generated by rearward movement of the movable member.

In the fastening tool of this aspect, during fastening operation with the fastener, the pin is pulled by the movable member moving the pin-gripping part rearward relative to the anvil. At this time, a strong axial force is applied as a reaction force to the rotatable member in a direction opposite to the direction in which the pin is pulled (i.e. in the forward direction). During the fastening operation with the fastener, the anvil, which is directly threadedly engaged with the housing or connected to the housing via a connecting member which is threadedly engaged with the housing, is pressed against the workpieces via the cylindrical part of the fastener and thus receives a rearward force. Therefore, if the forward axial force from the rotary member is transmitted to the housing, the anvil or the connecting member and the housing respectively receive forces in opposite directions. To cope with this problem, the receiving part of this aspect is configured to receive this axial force not via the housing and transmit the axial force to the anvil or the connecting member. This structure can reduce the possibility that forces in opposite directions are respectively applied to the anvil or the connecting member and the housing, thus resulting in loosening of the thread engagement between the anvil and the housing, or between the connecting member and the housing The manner of being transmitted "not via the housing" in this aspect does not necessarily require that no axial force is transmitted via the housing, but the axial force transmitted via the housing may be negligibly small compared with the axial force transmitted to the anvil or the connecting member via the receiving part.

Aspect 8

The fastening tool as defined in Aspect 7, wherein the receiving part includes a thrust bearing.

In this case, the thrust bearing allows smooth rotation of the rotary member, thereby avoiding the risk that the axial force may impede rotation of the rotary member.

Aspect 9

The fastening tool as defined in Aspect 8, wherein the receiving part includes an intervening member at least partially disposed between the thrust bearing and the anvil or between the thrust bearing and the connecting member in the front-rear direction.

Aspect 10

The fastening tool as defined in Aspect 9, wherein:

the thrust bearing includes a rotation part configured to rotate together with the rotary member, and the intervening member is inserted through the thrust bearing.

In this case, rational arrangement of the thrust bearing and ease of assembling can be realized by utilizing the intervening member.

Aspect 11

The fastening tool as defined in any one of Aspects 7 to 10, wherein:

the front end portion of the housing is threaded, and the anvil or the connecting member is also threaded, and a direction of threadedly engaging the housing and the anvil or the connecting member is opposite to a direction in which the rotary member is rotated when the movable member is moved rearward.

In this case, loosening of the thread engagement between the housing and the anvil or between the housing and the connecting member can be prevented which may otherwise be caused by rotation of the rotary member.

Aspect 12

The fastening tool as defined in any one of Aspects 7 to 11, wherein a rear end surface of the anvil or the connecting member is held in contact with the receiving part.

In this case, it is advantageous that during fastening operation with the fastener, the anvil or the connecting member can receive the force from the rear on the rear end surface which is held in surface contact with the receiving part.

Aspect 13

The fastening tool as defined in any one of Aspects 7 to 12, wherein the anvil, or both the anvil and the connecting member are formed of iron or iron-based alloy.

In this case, the strength of the anvil or the connecting member to which a large axial force is applied is sufficiently secured.

Aspect 14

The fastening tool as defined in any one of Aspects 7 to 13, wherein:

the pin-gripping part is held to be slidable along the driving axis within at least one of the anvil and the connecting member, and a sealing member is disposed on an outer periphery of the pin-gripping part to seal a gap between the pin-gripping part and the anvil or between the pin-gripping part and the connecting member.

In this case, when foreign matters (such as dust) enter between the pin-gripping part and the anvil or between the pin-gripping part and the connecting member, the foreign matters can be prevented from entering the housing.

Aspect 15

The receiving part is arranged in non-contact with the housing in the front-rear direction.

Aspect 16

A front end portion of the housing has a female-thread part, and a rear end portion of the anvil or the connecting member has a male-thread part configured to be threadedly engaged with the female-thread part.

Aspect 17

The rotary member and the movable member are a nut and a screw shaft, respectively, of a ball-screw mechanism.

Aspect 18

The intervening member includes:

a flange disposed between the thrust bearing and the anvil or between the thrust bearing and the connecting member in the front-rear direction; and a cylindrical part disposed between the screw shaft and the thrust bearing in a radial direction of the screw shaft.

Aspect 19

The intervening member is held by the housing in a state in which an outer peripheral surface of the flange is in contact with an inner peripheral surface of the housing and an inner peripheral surface of the cylindrical part is spaced apart from an outer peripheral surface of the screw shaft.

Aspect 20

The thrust bearing includes:

a front raceway ring held by the housing;

a rear raceway ring held by the rotary member; and a plurality of rolling elements rollably arranged between the front raceway ring and the rear raceway ring in the front-rear direction, and a rear end surface of the anvil or the connecting member is held in contact with the front raceway ring.

Correspondences between the features of the above-described embodiments and the features of Aspects 7 to 20 are as follows. The features of the above-described embodiments are merely exemplary and do not limit the features of Aspects 7 to 20. Each of the fastening tools 101 to 107 is an example of the "fastening tool". The fastener 8, the pin 81 and the collar 85 are examples of the "fastener", the "pin" and the "cylindrical part", respectively. The driving axis A1 is an example of the "driving axis". The body housing 10 is an example of the "housing". The female-thread part 126 is an example of the "front end portion of the housing". The anvil 62 is an example of the "anvil". The anvil-connecting sleeve 67 is an example of the "connecting member". The jaw assembly 63 and the jaw-connecting member 66 are an example of the "pin-gripping part". The motor 2 is an example of the "motor". The nut 41 is an example of the "rotary member". The screw shaft 56 is an example of the "movable member". Each of the front-receiving parts 53 and 54 is an example of the "receiving part".

Each of the thrust bearings 353 and 541 is an example of the "thrust bearing". The flange sleeve 530 is an example of the "intervening member". The rear ring 537 is an example of the "rotation part". The sealing member 663 is an example of the "sealing member". The female-thread part 126 and the male-thread part 672 are examples of the "female-thread part" and the "male-thread part", respectively. The nut 51 and the screw shaft 56 are examples of the "nut" and the "screw shaft", respectively. The flange 533 and the cylindrical part 531 are examples of the "flange" and the "cylindrical part", respectively. The front ring 542, the rear ring 544 and a plurality of rolling elements 547 are examples of the "front raceway ring", the "rear raceway ring" and the "rolling elements", respectively.

The fastening tool as defined in Aspects 7 to 20 is not limited to the fastening tools 101 to 107 of the above-described embodiments. For example, the following modifications may be made. At least one of these modifications can be employed in combination with at least one of any of the fastening tools 101 to 107 of the above-described embodiments, the above-described modifications, the aspects and the claimed invention.

For example, the fastening tools 101 to 107 may also be used with a known fastener of a type which is referred to as a blind rivet (or rivet), by replacing the nose assembly 61. Alternatively, each of the fastening tools 101 to 107 may be configured as a tool designed specifically for any one of a tear-off multi-piece swage type fastener, a shaft retaining multi-piece swage type fastener and a blind rivet. In this case, the structures of the body housing 10 and the driving mechanism 3 and the controlling manner of the control circuit 191 may be appropriately changed according to the type of the fastener. For example, in a fastening tool designed specifically for a shaft-retaining multi-piece swage type fastener, a pintail is not separated, so that a passage for the pintail formed in the screw shaft 56 and the container 148 may be omitted. In a fastening tool designed specifically for a tear-off multi-piece swage type fastener or a blind rivet, the thrust bearing 551 arranged behind the nut 51 may be omitted.

The structures and materials of the nose assembly 61 (the anvil 62 and the jaw assembly 63) and the nose adapter 65 (the anvil-connecting sleeve 67, the jaw-connecting member 66, the fixing ring 68) may be appropriately changed.

For example, the shape of the anvil 62 and the manner of connecting the anvil 62 to the body housing 10 via the nose adapter 65 may be changed. The shape of the anvil-connecting sleeve 67 can be appropriately changed according to the shape of the anvil 62. Further, the anvil 62 may be threadedly engaged with the female-thread part 126 directly and not via the anvil-connecting sleeve 67. In this case, the rear end portion of the anvil 62 may be formed like the male-thread part 672.

Similarly, the shape of the jaw assembly 63 and the manner of connecting the jaw assembly 63 to the screw shaft 56 via the jaw-connecting member 66 may be changed. The jaw assembly 63 may be connected to the screw shaft 56 directly and not via the jaw-connecting member 66. The jaw assembly 63 may be configured such that the force of the claws gripping the pin varies as the claws move in the radial direction along with movement of the jaw assembly 63 relative to the anvil 62 in the front-rear direction. For example, the shape and number of the claws may be appropriately changed.

The structures of the front-receiving parts 53, 54 may be appropriately changed. For example, the front ring 536 of the thrust bearing 535 may be omitted and the flange 533 of the flange sleeve 530 may also be serve as a raceway ring. The rear ring 537 of the thrust bearing 535 and the rear ring 544 of the thrust bearing 541 may be integrated with the nut 51. Balls may be employed, in place of the rollers, as the rolling elements 539, 547. Further, a member (such as a washer) (other than the front-receiving part 53, 54) which is not held in contact with the first housing 12 in the axial direction (the front-rear direction) may be additionally arranged between the rear end surface 673 of the anvil-connecting sleeve 67 and the frond end surface 513 of the nut 51. The structure of the thrust bearing 551 of the rear-receiving part 55 may also be similarly changed.

The structures and arrangement of the motor 2, the driving mechanism 3, the controller 19 and the operation part 187 may be appropriately changed.

For example, a motor with a brush may be employed, in place of the brushless motor. Further, an AC motor which is driven by power supplied from an external AC power source may be employed as the motor 2. The motor 2 need not be coaxially arranged with the planetary gear reducer 300 and the first intermediate shaft 31. For example, the rotation axis A2 of the motor shaft 23 may be parallel to the axis of the planetary gear reducer 300 and the first intermediate shaft 31. The motor 2 may be arranged such that the rotation axis A2 of the motor shaft 23 crosses the driving axis A1.

In the driving mechanism 3, a feed-screw mechanism including a nut and a screw shaft directly engaged with the nut may be employed, in place of the ball-screw mechanism 5.

The idler gear 311 disposed between the nut-driving gear 311 of the first intermediate shaft 31 and the driven gear 511 of the nut 51 may be omitted, and the nut-driving gear 311 and the driven gear 511 may be engaged with each other, or a different gear may be disposed therebetween.

The number of the stages of the planetary gear reducer 300 (i.e. the number of the planetary gear mechanisms included in the planetary gear reducer 300) and the structure of the planetary gear mechanism in each stage may be appropriately changed. For example, the planetary gear reducer 300 may include two or four or more planetary gear mechanisms. In place of the planetary gear reducer 300, a gear reducer including a gear train (a train of spur gears, helical gears, or bevel gears, for example) other than a planetary gear mechanism may be arranged between the motor 2 and the ball-screw mechanism 5 on the transmission path.

The controller 19 may be housed in the body housing 10 rather than in the battery housing 18. Further, in the above-described embodiments, the control circuit 61 is formed by a microcomputer including a CPU. However, the control circuit 61 may be formed, for example, by a programmable logic device such as an ASIC (Application Specific Integrated Circuit) and an FPGA (Field Programmable Gate Array).

The input device used to input information for specifying the operation mode is not limited to the push-button switches of the operation part 187, but it may be, for example, a slide switch, a rotary dial or a touch panel. Information to be inputted from the operation part 187 is not limited to information relating to the operation mode. For example, it may be information relating to the type of the fastener and/or the workpieces, desired pulling force, a moving speed of the screw shaft 56 (pulling speed) and an environmental temperature. Further, the operation part 187 may be provided in another position (for example, on the body housing 10), or it may be omitted.

The structures, positions and materials of the body housing 10, the handle 17, the hand guards 175, 176 and the battery housing 18 may also be appropriately changed according to the above-described modifications of the internal mechanism or regardless of the modifications.

For example, the first housing 12 and the second housing 14 may be integrally formed with each other. The first housing 12 and the second housing 14 may respectively have different shapes. The speed-reducer assembly 30 does not need to be removable from the first housing 12. Specifically, the gear-reducer case 13 may be integrally formed with the first housing 12. The first housing 12 may be formed by connecting a plurality of parts different from those of the above-described embodiments. Similarly, the second housing 14 does not need to be formed of resin integrally with the handle 17, the hand guard 175 or 176 and the battery housing 18. At least one of these parts may be separately formed and connected to the other parts with screws or the like. The hand guard 175, 176 may be omitted.

The number of the battery-mounting parts 181 (i.e. the number of the batteries 182 which can be mounted) may be one or three or more. Further, the position of the battery-mounting parts 181 is not limited to the lower portion of the battery housing 18. The battery guard 185 may be omitted.

Further, following Aspects 21 to 40 are provided for the purpose of providing a fastening tool configured such that a pulling force to be exerted is variable. Any one of Aspects 21 to 40 can be employed independently, or in combination with at least one of the other aspects. Alternatively, at least one of Aspects 21 to 40 can be employed in combination with at least one of the fastening tools 101 to 107 of the above-described embodiments, the above-described modifications and aspects and the claimed invention.

Aspect 21

A fastening tool configured to fasten workpieces via a fastener having a pin and a cylindrical part, the fastening tool comprising:

an anvil configured to abut on the cylindrical part of the fastener, the anvil extending along the driving axis;

a pin-gripping part configured to grip the pin and held to be movable along the driving axis relative to the anvil;

a motor; and a driving mechanism including a final output shaft connected to the pin-gripping part, the driving mechanism being configured to convert rotational motion of the motor to linear motion of the final output shaft and move the pin-gripping part relative to the anvil, wherein:

the driving mechanism includes a gear reducer provided on a transmission path from the motor to the final output shaft, and the gear reducer is configured such that a reduction ratio thereof is variable.

In the fastening tool according to this aspect, the reduction ratio of the gear reducer and thus torque to be outputted from the gear reducer can be changed. Therefore, the force of pulling the pin with the pin-gripping part connected to the final output shaft can be easily changed, not by control of the motor, but by changing the reduction ratio.

Aspect 22

The fastening tool as defined in Aspect 21, wherein the gear reducer includes a gear train and is configured to change the reduction ratio by changing engagement of gears of the gear train.

In this case, the reduction ratio can be rationally changed.

Aspect 23

The fastening tool as defined in Aspect 21 or 22, wherein the gear reducer includes multi-stage planetary gear mechanisms and is configured to change the reduction ratio by changing the number of effective stages of the planetary gear mechanisms.

In this case, the gear reducer can be made relatively small and can provide a relatively large reduction ratio, compared with a gear reducer formed by a combination of spur gears or other gears.

Aspect 24

The fastening tool as defined in any one of Aspects 21 to 23, wherein the gear reducer is configured to change the reduction ratio in response to an external operation of a user.

In this case, the user can easily change the force of pulling the pin with the pin-gripping part, depending on the materials and specifications of the fastener and the workpieces to be used, through the external operation.

Aspect 25

The fastening tool as defined in Aspect 24, further comprising:

an operation member configured to be moved by the external operation, wherein:

the gear reducer is configured to change the reduction ratio along with movement of the operation member.

In this case, the user can easily change the force of pulling the pin with the pin-gripping part by simply moving the operation member.

Aspect 26

The fastening tool as defined in Aspect 24, further comprising:

an input device into which information is inputted in response to the external operation, wherein:

the gear reducer is configured to change the reduction ratio based on the information inputted via the input device.

In this case, the user can easily change the force of pulling the pin with the pin-gripping part by simply operating the input device to input information.

Aspect 27

The fastening tool as defined in any one of Aspects 21 to 23, further comprising:

a temperature sensor configured to measure temperature, wherein:

the gear reducer is configured to change the reduction ratio based on the temperature measured by the temperature sensor.

In this case, the reduction ratio can be changed, for example, according to characteristic change of the motor due to change of an environmental temperature, or heat generation of a control part configured to control the motor.

Aspect 28

The fastening tool as defined in any one of Aspects 21 to 23, further comprising:

a current detector configured to detect a current flowing to the motor, wherein:

the gear reducer is configured to change the reduction ratio based on a magnitude of the current detected by the current detector.

In this case, the reduction ratio can be changed according to load.

Aspect 29

The driving mechanism includes a ball-screw mechanism or a feed-screw mechanism, the gear reducer is disposed between the motor and the ball-screw mechanism or between the motor and the feed-screw mechanism on the transmission path.

Aspect 30

The ball-screw mechanism or the feed screw mechanism includes a nut supported by the housing so as to be rotatable around the driving axis, and the final output shaft configured to linearly move along the driving axis along with rotation of the nut.

Aspect 31

Each stage of the multi-stage planetary gear mechanisms includes a sun gear, an internal gear, a carrier, and a plurality of planetary gears supported by the carrier and engaged with the sun gear and the internal gear, and the gear reducer is configured to change the number of the effective stages by moving the internal gear of any one of the stages in an axial direction.

Aspect 32

The operation member is mechanically connected directly or indirectly to the gear reducer and configured to change the engagement of the gears of the gear train or the number of the effective stages of the multi-stage planetary gear mechanisms is changed by moving the internal gear.

Aspect 33

The fastening tool further comprises:

an actuator having an actuation part configured to operate in response to activation of the actuator, the actuator being configured to mechanically act on the gear reducer via the actuation part; and a control part configured to activate the actuator based on the information inputted via the input device.

Aspect 34

The fastening tool further comprises:

an actuator having an actuation part configured to operate in response to activation of the actuator, the actuator being configured to mechanically act on the gear reducer via the actuation part; and a control part configured to activate the actuator based on the temperature measured by the temperature sensor.

Aspect 35

The fastening tool further comprises:

an actuator having an actuation part configured to operate in response to activation of the actuator, the actuator being configured to mechanically act on the gear reducer via the actuation part; and a control part configured to activate the actuator based on a magnitude of the current detected by the current detector.

Aspect 36

In any one of Aspects 33 to 35, the actuation part is configured to change the engagement of the gears of the gear train or the number of the effective stages of the planetary gear mechanisms by mechanically acting on the gear reducer.

Aspect 37

In Aspect 34 or 36, the control part is configured to, when the temperature exceeds a threshold, control the actuator to change the reduction ratio from a first reduction ratio to a second reduction ratio, the first reduction ratio being specified for a case in which the temperature does not exceed the threshold, the second reduction ratio being larger than the first reduction ratio.

Aspect 38

In Aspect 37, the control part is configured to, when the temperature decreases to the threshold or less again, control the actuator to change the reduction ratio from the second reduction ratio to the first reduction ratio.

Aspect 39

In Aspect 35 or 36, the control part is configured to, when the magnitude of the current exceeds a threshold, control the actuator to change the reduction ratio from a first reduction ratio to a second reduction ratio, the first reduction ratio being specified for a case in which the magnitude of the current does not exceed the threshold, the second reduction ratio being larger than the first reduction ratio.

Aspect 40

In Aspect 39, the control part is configured to, when the magnitude of the current decreases to the threshold or less again, control the actuator to change the reduction ratio from the second reduction ratio to the first reduction ratio.

Correspondences between the features of the above-described embodiments and the features of Aspects 21 to 40 are as follow. The features of the above-described embodiments are merely exemplary and do not limit the features of aspects 21 to 40. Each of the fastening tools 104 to 107 is an example of the "fastening tool". The fastener 8, the pin 81 and the collar 85 are examples of the "fastener", the "pin" and the "cylindrical part", respectively. The body housing 10 is an example of the "housing". The anvil 62 and the jaw assembly 63 are examples of the "anvil" and the "pin-gripping part", respectively. The motor 2 is an example of the "motor". The driving mechanism 3 is an example of the "driving mechanism". The screw shaft 56 is an example of the "final output shaft". The planetary gear reducer 4 is an example of the "gear reducer". The planetary gear mechanisms 41, 42 and 43 are an example of the "gear train" and the "multi-stage planetary gear mechanisms". The speed-change lever 471 is an example of the "operation member". The operation part 187 (the push-button switch) is an example of the "input device". The temperature sensor 49 is an example of the "temperature sensor". The current-detection circuit 193 is an example of the "current detector". The ball-screw mechanism 5 is an example of the "ball-screw mechanism". The nut 51 and the screw shaft 56 are examples of the "nut" and the "final output shaft", respectively. The solenoid 48, the plunger 483 and the control circuit 191 are examples of the "actuator", the "actuation part" and the "control part", respectively.

The fastening tool as defined in each of Aspects 21 to 40 is not limited to the fastening tools 104 to 107 of the above-described embodiments. For example, the following modifications may be made. At least one of these modifications can be employed in combination with at least one of any of the fastening tools 104 to 107 of the above-described embodiments, the above-described modifications, the aspects and the claimed invention.

For example, the fastening tools 104 to 107 may also be used with a known fastener of a type which is referred to as a blind rivet (or rivet), by replacing the nose assembly 61. Alternatively, the fastening tools 104 to 107 may be configured as a tool designed specifically for any one of a tear-off multi-piece swage type fastener, a shaft-retaining multi-piece swage type fastener and a blind rivet. Any type of fastener is available in plural kinds, varying, for example, in the length, diameter and material of a pin, a collar or a sleeve. Therefore, in such a specifically designed tool, like in the above-described embodiment, the gear reducer (for example, the planetary gear reducer 4) capable of changing the reduction ratio can also be employed. In the case of the specifically designed tool, the structures of the body housing 10 and the driving mechanism 3 and the controlling manner of the control circuit 191 may be appropriately changed, according to the type of the fastener. For example, in a fastening tool designed specifically for a shaft-retaining multi-piece swage type fastener, a pintail is not separated, so that a passage for the pintail formed in the screw shaft 56 and the container 148 may be omitted.

The structures and materials of the nose assembly 61 and the nose adapter 65 may be appropriately changed. For example, the shape of the anvil 62 and the manner of connecting the anvil 62 to the body housing 10 via the nose adapter 65 may be changed. The jaw assembly 63 may be configured such that the force of the claws gripping the pin varies as the claws move in the radial direction along with movement of the jaw assembly 63 relative to the anvil 62 in the front-rear direction. For example, the shape and number of the claws and the manner of connecting the jaw assembly 63 to the screw shaft 56 may be appropriately changed.

The structures and positions of the motor 2, the driving mechanism 3, the controller 19 may be appropriately changed. According to such modifications, or regardless of the modifications, the shapes of the body housing 10, the handle 17 and the battery housing 18 may also be appropriately changed. For example, the number of the battery-mounting parts 181 (i.e. the number of the batteries 182 which can be mounted) may be one or three or more. Further, the position of the battery-mounting parts 181 is not limited to the lower portion of the battery housing 18. The battery guard 185 may be omitted.

For example, a motor with a brush may be employed, in place of the brushless motor. Further, an AC motor which is driven by power supplied from an external AC power source may be employed as the motor 2. The motor 2 may be arranged such that the rotation axis A2 of the motor shaft 23 crosses the driving axis A1.

In the driving mechanism 3, a feed-screw mechanism, including a nut having a female thread on its inner periphery and a screw shaft having a male thread on its outer periphery and threadedly engaged directly with the nut, may be employed, in place of the ball-screw mechanism 5. Further, in the ball-screw mechanism 5, the screw shaft 56 may be supported to be rotatable around the driving axis A1 while being prevented from moving in the front-rear direction, and the nut 51 may be configured to move in the front-rear direction along with rotation of the screw shaft 56. In this case, the jaw assembly 63 may be directly or indirectly connected to the nut 51, which serves as the final output shaft.

The idler gear 331 disposed between the nut-driving gear 311 of the first intermediate shaft 31 and the driven gear 511 of the nut 51 may be omitted, and the nut-driving gear 31 and the driven gear 511 may be engaged with each other, or a different gear may be disposed therebetween.

The number of the stages of the planetary gear reducer 4 (i.e. the number of the planetary gear mechanisms included in the planetary gear reducer 4) and the structures of the planetary gear mechanisms 41, 42, 43 may be appropriately changed. For example, the planetary gear reducer 4 may include two or four or more planetary gear mechanisms. Further, the number of effective stages may be changed by axial movement of the internal gear of any stage. In place of the planetary gear reducer 4, a gear reducer including a gear train (a train of spur gears, helical gears, or bevel gears, for example) other than a planetary gear mechanism may be employed. In this case, the reduction ratio can be changed, for example, by moving a specific gear, which is slidably disposed, and selectively engaging the specific gear with one of two gears having a different number of teeth.

As the operation member for changing the reduction ratio which interlocks with the planetary gear reducer 4 (or other gear reducer), for example, a rotary dial, or a button which is movable in the left-right direction may be adopted, in place of the speed-change lever 471 which is movable in the front-rear direction.

In the above-described embodiments, the control circuit 191 is formed by a microcomputer including a CPU. However, the control circuit 191 may be formed, for example, by a programmable logic device such as an ASIC (Application Specific Integrated Circuit) and an FPGA (Field Programmable Gate Array). Further, a plurality of control circuits may be provided to control driving of the motor 2 and activation of the solenoid 48 independently.

The input device used to input information for changing the reduction ratio is not limited to the push-button switches of the operation part 187, but it may be, for example, a slide switch, a rotary dial or a touch panel. Information to be inputted from the operation part 187 is not limited to information relating to the type of the fastener and/or the workpieces. For example, it may be information relating to desired pulling force, a moving speed of the screw shaft 56 (pulling speed) and an environmental temperature. Further, the operation part 187 may be provided, for example, on the body housing 10.

The structure for changing the reduction ratio by mechanically acting on the planetary gear reducer 4 (or other gear reducer) is not limited to the solenoid 48. An actuator (other than the solenoid 48) having an actuation part (for example, a rotatable actuation part) which is activated and operated by the control circuit 191 may be adopted.

The temperature sensor 49 may be disposed in a place other than the vicinity of the controller 19 (for example, in the vicinity of the motor 2 within the body housing 10). In this case, the control circuit 191 is capable of changing the reduction ratio according to characteristic change of the motor due to change of the environmental temperature.

DESCRIPTION OF THE NUMERALS

101, 102, 103, 104, 105, 106, 107: fastening tool, 10: housing, 12: first housing, 121: front wall, 122: rear wall, 123: recess, 125: front part, 126: male-thread part, 127: rear part, 13: gear-reducer case, 131: front wall, 133: projection, 137: sealing member, 14: second housing, 141: motor region, 142: shaft region, 143: partition, 145: inlet, 146: outlet, 147: opening, 148: container, 149: LED lamp, 16: nose, 17: handle, 171: trigger, 172: switch, 175, 176: hand guard, 177: inlet, 178: partition, 18: battery housing, 181: battery-mounting part, 182: battery, 185: battery guard, 187: operation part, 19: controller, 191: control circuit, 193: current-detection circuit, 2: motor, 3: driving mechanism, 5: ball-screw mechanism, 8: fastener, 21: motor body part, 23: motor shaft, 27: fan, 30: speed-reducer assembly, 300: planetary gear reducer, 302: sun gear, 303: carrier, 31: intermediate shaft, 311: nut-driving gear, 33: second intermediate shaft, 331: idler gear, 4: planetary gear reducer, 40: gear case, 401: coupling ring, 402: teeth, 41: planetary gear mechanism, 411: sun gear, 413: carrier, 415: internal gear, 42: planetary gear mechanism, 424: planetary gear, 425: internal gear, 426: outer teeth, 427: annular groove, 43: planetary gear mechanism, 433: carrier, 435: internal gear, 45: switching ring, 451: exterior part, 452: pin, 454: extension piece, 455: projection, 471: speed-change lever, 472:

interlocking member, 473: projection, 48: solenoid, 481: case, 483: plunger, 49: temperature sensor, 51: nut, 511: driven gear, 513: front end surface, 514: rear end surface, 521, 522: bearing, 53: front-receiving part, 530: flange sleeve, 531: cylindrical part, 532: stepped part, 533: flange, 534: front end surface, 535: thrust bearing, 536: front ring, 537: rear ring, 538: cage, 539: rolling element, 54: front-receiving part, 541: thrust bearing, 542: front ring, 543: front end surface, 544: rear ring, 545: recess, 546: cage, 547: rolling element, 55: rear-receiving part, 551: thrust bearing, 56: screw shaft, 560: driving shaft, 561: extension shaft, 61: nose assembly, 62: anvil, 621: bore, 625: locking flange, 63: jaw assembly, 65: nose adapter, 66: jaw-connecting member, 661: large-diameter part, 663: sealing member, 67: anvil-connecting sleeve, 671: bore, 672: male-thread part, 673: rear end surface, 675: flange, 68: fixing ring, 81: pin, 811: shaft part, 815: head, 85: collar, A1: driving axis, A2: rotation axis, A3: rotation axis, W: workpiece

What is claimed is:

1. A fastening tool configured to fasten workpieces via a fastener having a pin and a cylindrical part, the fastening tool comprising:

a housing extending along a first axis, the first axis defining a front-rear direction of the fastening tool;

a handle protruding from the housing in a direction crossing the first axis;

an anvil configured to abut on the cylindrical part of the fastener, the anvil being connected to a front end portion of the housing so as to extend along the first axis;

a jaw assembly configured to grip the pin, the jaw assembly being held to be movable along the first axis relative to the anvil;

a motor housed in the housing; and a driving mechanism at least partially housed in the housing, the driving mechanism being configured to be driven by power of the motor and move the jaw assembly in the front-rear direction relative to the anvil, wherein:

the driving mechanism includes:

a rotary member having a driven gear on its outer periphery, the rotary member being supported by the housing so as to be rotatable around the first axis;

a movable shaft connected to the jaw assembly the movable shaft being engaged with the rotary member and configured to be linearly moved in the front-rear direction by rotation of the rotary member;

a driving gear on a second axis and configured to be rotated around the second axis by power of the motor, wherein, when a direction orthogonal to the first axis and corresponding to an extending direction of the handle is defined as an up-down direction of the fastening tool, and in the up-down direction, a direction toward the handle protrudes from the housing is defined as a downward direction, the second axis extends in parallel to the first axis below the first axis; and an idler gear engaged with the driving gear and the driven gear; and the housing includes:

a first housing that houses at least the rotary member, the driving gear and the idler gear, and a second housing that houses at least the motor and a portion of the movable shaft.

2. The fastening tool as defined in claim 1, wherein:

the driving mechanism further includes a planetary gear reducer between the motor and the driving gear on a power transmission path, and the planetary gear reducer is on the second axis and in a region directly below the rotary member within the housing.

3. The fastening tool as defined in claim 2, wherein the driven gear is forward of a center of the rotary member in the front-rear direction.

4. The fastening tool as defined in claim 3, wherein the planetary gear reducer and the idler gear partially overlap with each other when viewed from the front or rear.

5. The fastening tool as defined in claim 4, wherein:

the idler gear is rotatable around a third axis, the third axis extends in parallel to the first and second axes between the first and second axes in the up-down direction, and the first, second and third axes are on a same plane.

6. The fastening tool as defined in claim 5, wherein the handle protrudes from a portion of the housing directly below the planetary gear reducer.

7. The fastening tool as defined in claim 2, wherein the planetary gear reducer and the idler gear partially overlap with each other when viewed from the front or rear.

8. The fastening tool as defined in claim 1, wherein the second housing houses at least a portion of the first housing.

9. The fastening tool as defined in claim 1, wherein:

the driving mechanism further includes a planetary gear reducer between the motor and the driving gear on a power transmission path, the planetary gear reducer forms a speed-reducer assembly together with a case for housing the planetary gear reducer, and the speed-reducer assembly is removably connected to the first housing.

10. The fastening tool as defined in claim 9, wherein a seal is between the speed-reducer assembly and the first housing.

11. The fastening tool as defined in claim 9, wherein the second housing houses at least a portion of the first housing and the speed-reducer assembly.

12. The fastening tool as defined in claim 1, wherein:

an internal space of the second housing includes a first region in which the motor is housed and a second region in which at least a portion of the movable shaft is housed, and the internal space is partitioned into the first region and the second region by a partition wall.

13. The fastening tool as defined in claim 12, wherein the second housing has an opening providing communication between an outside of the second housing and the first region, and the opening serves as an inlet or an outlet for cooling air for the motor.

14. The fastening tool as defined in claim 1, wherein:

the driving mechanism further includes a planetary gear reducer between the motor and the driving gear on a power transmission path, and the handle protrudes from a portion of the housing directly below the planetary gear reducer.

15. The fastening tool as defined in claim 1, wherein:

the idler gear is rotatable around a third axis, and the third axis extends in parallel to the first and second axes between the first and second axes in the up-down direction.

16. The fastening tool as defined in claim 15, wherein the first, second and third axes are arranged on a same plane.

17. The fastening tool as defined in claim 1, further comprising:

a battery housing including a plurality of battery mounts, each of the plurality of battery mounts is configured to removably receive a battery, wherein:

the plurality of battery mounts are arranged side by side in the front-rear direction below the handle.

18. The fastening tool as defined in claim 1, wherein:

the driving mechanism further includes a planetary gear reducer between the motor and the driving gear on a power transmission path, and the planetary gear reducer forms a speed-reducer assembly together with a case for housing the planetary gear reducer, the speed-reducer assembly is removably connected to the first housing, and the second housing houses at least a portion of the first housing and the speed-reducer assembly.

* * * * *